US007344334B2

(12) United States Patent
Thorkelson

(10) Patent No.: US 7,344,334 B2
(45) Date of Patent: Mar. 18, 2008

(54) PAVER SYSTEM

(75) Inventor: Steven Thorkelson, Minnetonka, MN (US)

(73) Assignee: Vast Enterprises LLC, Eden Prairie, MN (US)

( * ) Notice: Subject to any disclaimer, the term of this patent is extended or adjusted under 35 U.S.C. 154(b) by 0 days.

(21) Appl. No.: 11/435,319

(22) Filed: May 16, 2006

(65) Prior Publication Data

US 2007/0269265 A1 Nov. 22, 2007

(51) Int. Cl.
*E01C 5/00* (2006.01)
*E01C 5/18* (2006.01)

(52) U.S. Cl. ..... 404/29; 404/28; 404/31; 404/32; 404/33; 404/34; 404/36

(58) Field of Classification Search ..... 404/28–36
See application file for complete search history.

(56) References Cited

U.S. PATENT DOCUMENTS

| | | | | | |
|---|---|---|---|---|---|
| 1,728,991 | A * | 9/1929 | Draullette | 404/33 |
| 3,832,078 | A * | 8/1974 | Nakayama | 404/44 |
| 4,749,302 | A * | 6/1988 | DeClute | 404/37 |
| 5,006,011 | A * | 4/1991 | Hiyashi | 404/37 |
| 5,363,614 | A * | 11/1994 | Faulkner | 52/263 |
| 5,496,129 | A | 3/1996 | Dubè | |
| 5,615,971 | A | 4/1997 | Boevè | |
| 5,630,674 | A * | 5/1997 | Inaba | 404/2 |
| 5,685,666 | A | 11/1997 | Marshall et al. | |
| 5,816,738 | A * | 10/1998 | Harnapp | 404/18 |
| 5,957,619 | A * | 9/1999 | Kinoshita et al. | 404/31 |
| 5,993,107 | A | 11/1999 | Bauer | |
| 6,000,877 | A | 12/1999 | Fishback et al. | |
| 6,027,280 | A | 2/2000 | Conners et al. | |
| 6,071,041 | A * | 6/2000 | Knight | 405/16 |
| 6,171,015 | B1 * | 1/2001 | Barth et al. | 404/34 |
| 6,185,893 | B1 | 2/2001 | Gaston | |
| 6,263,633 | B1 | 7/2001 | Hagenah | |
| 6,551,016 | B2 | 4/2003 | Guidon | |
| 6,694,697 | B2 * | 2/2004 | Shepherd | 52/668 |
| 6,702,514 | B2 | 3/2004 | Kaneko et al. | |
| 6,739,797 | B1 | 5/2004 | Schneider | |
| 6,851,236 | B1 | 2/2005 | Harvey | |
| 6,863,469 | B2 | 3/2005 | Bolduc et al. | |
| 6,988,847 | B2 | 1/2006 | Lazar | |
| 7,001,101 | B1 | 2/2006 | DeRose | |
| 2002/0141821 | A1 | 10/2002 | Guidon | |
| 2003/0086762 | A1 * | 5/2003 | Oka et al. | 404/18 |
| 2003/0103810 | A1 * | 6/2003 | Wiley | 404/75 |

(Continued)

FOREIGN PATENT DOCUMENTS

AU WO 2005/035216 A1 * 4/2005

OTHER PUBLICATIONS http://uni-groupusa.org/uni-eco-.htm, UNI Eco Stone, UNI-Group U.S.A., Manufacturers of UNI® Paving Stones, Mar. 6, 2006, 2 pgs.

*Primary Examiner*—Raymond W Addie
(74) *Attorney, Agent, or Firm*—Dorsey & Whitney LLP

(57) ABSTRACT

A paver system comprising a plurality of paver pieces and at least one substrate. Each of the paver pieces has a top surface and a bottom surface. The bottom surface of the paver pieces is configured for mating with the upper surface of the substrate, whereby paver pieces coupled to the substrate are prevented from moving laterally.

19 Claims, 41 Drawing Sheets

U.S. PATENT DOCUMENTS

2003/0173540 A1* 9/2003 Mortz et al. ..... 252/301.36
2004/0028471 A1* 2/2004 Smithdale ..... 404/44
2004/0228684 A1 11/2004 Lombardo
2005/0182160 A1 8/2005 Milani Nejad et al.
2005/0183632 A1 8/2005 Sturre
2005/0193679 A1 9/2005 Langsdorff
2005/0232696 A1 10/2005 Cheung

* cited by examiner

PAVER SYSTEM

FIELD OF THE INVENTION

This invention relates generally to a paver system, and more specifically to a configurable paver system comprising a plurality of paver pieces, the paver system enabling easy alignment and distribution of load.

BACKGROUND OF THE INVENTION

Paver systems are frequently used in landscaping and outdoor construction. Construction pavers are widely used today in residential, commercial, and municipal applications that include walkways, patios, parking lots, and streets. Stone and brick provide an historical aesthetic value but are expensive and not suitable for some applications. In most cases, these pavers are made from a cementitious mix (i.e., concrete) or clay and are traditionally extruded or molded into various shapes. These are heavy and can be difficult to install, due both to weight and geometrical configuration.

Although cementitious pavers are widely used throughout the construction industry, the materials prevent cost effective, mass production of complex shapes. Because of the constraints of the materials and corresponding manufacturing process, the most typical shapes include simple rectangular or octagon blocks with little aesthetic value and limited variability. Further, finely detailed features and precision dimensions cannot efficiently be formed on such blocks. In addition, their weight and typical designs deter efficient installation. The typical manner of installing cementitious or clay pavers is labor intensive, time consuming, and generally includes substantial overhead equipment costs. The simple shapes of cementitious or clay pavers limit their installation to an intensive manual process. Thus, the costs for cementitious paver systems are high and include high manual labor costs.

Further, the weight of the cementitious or clay pavers causes the pavers to be inefficient to transport. Trucks are "underloaded," due to reaching weight restrictions before volume restrictions, thereby inflating transportation costs. Additionally, trucks or other transport devices loaded with cementitious or clay pavers are heavy and may not be driven over soft surfaces, such as a yard, without risk of deforming the surface.

The inherent nature of the cementitious and clay pavers results in high installation and transportation costs. These costs contribute to restricting the manufacturing process to be 'simple' and inexpensive to be cost effective on a total installed cost basis as compared to concrete or asphalt alternatives. Thus, in general, the entire cementitious paver process is in a cycle that deters the evolution of the product.

For many residential and commercial construction applications, it would be desirable to have the aesthetic value that concrete, brick, or clay pavers offer without the substantial logistic, overhead, and labor implications inherent with these systems. In addition, it would be desirable to have products for walkway/driveway/parking lot systems that promote environmental stewardship, are environmentally friendly, and enhance safety.

SUMMARY OF THE INVENTION

A paver system is provided. The paver system comprises a plurality of paver pieces formed of a polymeric material. The material is precisely formable and lightweight and may be a composite. The paver pieces are interlocking with a substrate or with one another to prevent lateral migration relative to each other. Additionally, the paver pieces may effectively prevent lateral migration of adjacent substrates with respect to one another.

In one embodiment, the paver system comprises a plurality of polymeric paver pieces and at least one substrate. Each of the paver pieces has a coupling feature and the substrate has a complementary coupling feature. The paver pieces mate with the substrate via the coupling features, whereby the paver pieces coupled to the substrate are prevented from moving laterally.

In another rembodiment, a paver system preassembled unit is provided. The paver system preassembled unit comprises a plurality of paver pieces and at least one substrate. The substrate supports the plurality of paver pieces with their top surfaces in a closely spaced relationship substantially in a common plane. The paver pieces cover substantially the entire substrate. The paver pieces include a coupling feature and the substrate includes a complementary coupling feature, the paver pieces mating with the substrate via the coupling feature and the complementary coupling feature, whereby the paver pieces preassembled on the substrate in mating relationship are prevented from moving laterally. The combined preassembled paver pieces and substrate may be placed as a unit in final position on a graded surface.

While multiple embodiments are disclosed, still other embodiments of the present teachings will become apparent to those skilled in the art from the following detailed description, which shows and describes illustrative embodiments. As will be realized, the teachings are capable of modifications in various obvious aspects, all without departing from the spirit and scope of the present teachings. Accordingly, the drawings and detailed description are to be regarded as illustrative in nature and not restrictive.

DETAILED DESCRIPTION OF THE INVENTION

Introduction

Figure 1:
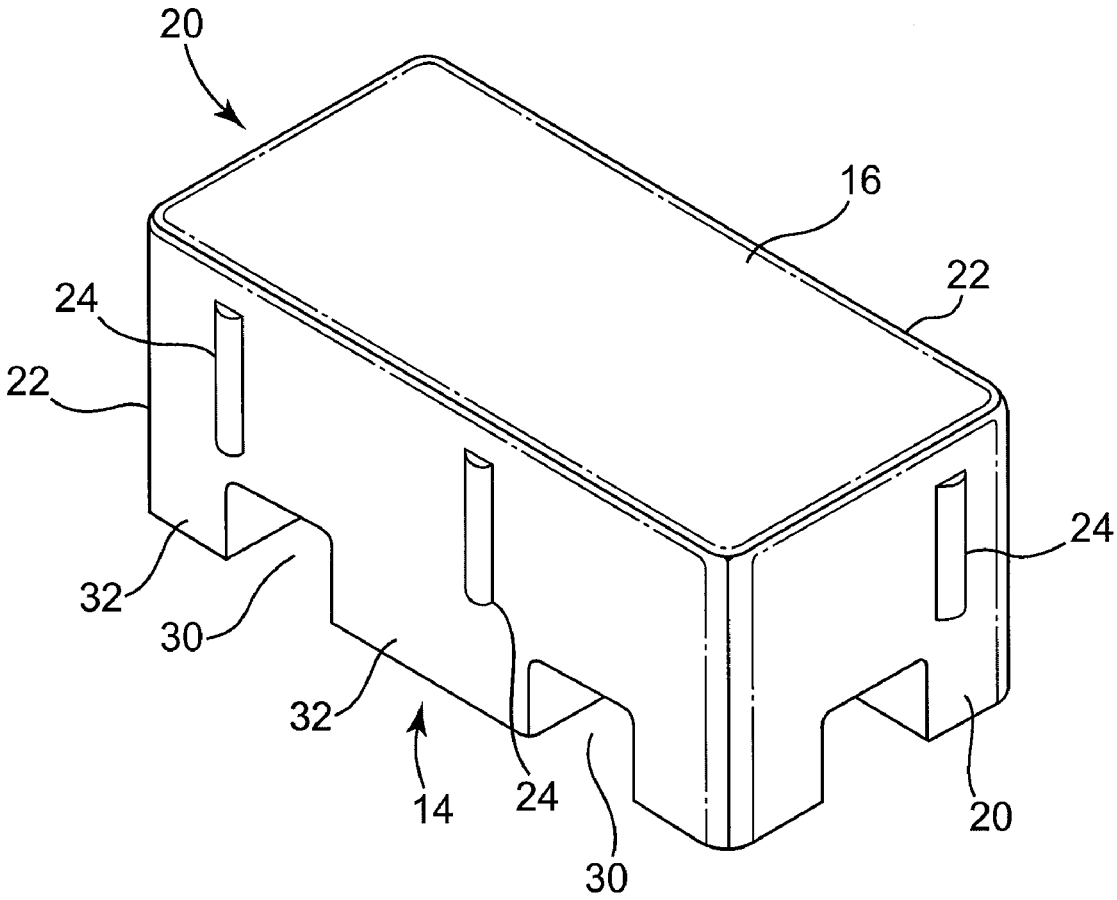
FIG. 1 is a top pictorial view of a paver piece in accordance with one embodiment.

A configurable paver system is provided. The paver system comprises a plurality of paver pieces formed of a polymeric material. The material is precisely formable and lightweight and may be a composite with materials held in a matrix with polymer binders. The paver pieces are interlocking with a substrate or with one another to prevent lateral migration relative to each other, i.e., motion in the plane of the paved surface. Additionally, the paver pieces, when placed on a plurality of substrates, may effectively prevent lateral migration of adjacent substrates with respect to one another. The paver system enables easy alignment, pre-configuration or pre-loading of installation units, and improved distribution of load. In some embodiments, the paver system may be able to deform and to flex to accommodate non-level ground and/or sharp points extending from the ground, i.e., the surface to be paved.

The paver pieces comprise a formable, lightweight polymeric or composite-polymeric material. Any formable, lightweight polymeric material may be used with a compressive strength approximating or exceeding that of cementitious payers, for example a composite of rubber and plastic. In contrast to brittle, cementitious materials previously used for paving systems, the formable, lightweight material permits precise forming or configuring of the paver pieces, including protrusions and sharp corners less suitable for low tensile strength materials. Further, in some embodiments, the lightweight material is somewhat elastic to permit deformation of the paver system over small protrusions and flex of the paver system over non-level surfaces. Thus, in contrast to cementitious or clay paver systems wherein the payers may crack or break when subjected to tensile stress, the polymeric paver pieces resist such damage.

A method for manufacturing a composite polymeric material from recycled materials (e.g., a combination of recycled rubber from tires and recycled plastics such as polypropylene (PP) and/or high density polyethylene (HDPE)) is further provided.

Using a polymeric-matrix paver system, the weight of the paver system is significantly less per square unit than the weight of a traditional paver system. For example, the paver system may weigh no more than about 9 lbs per sq. ft. laid. The paver system including, for example, substrates and multiple paver pieces may be packaged in a ready-to-use pre-assembled unit for a consumer. The ready-to-use packages may be provided on a pallet. For smaller users, such as a homeowner laying a patio, the paver pieces and substrates may be packaged in a small container that is easy to carry. For example, a plurality of paver pieces and substrates may be provided in an approximately one cubic foot container (providing approximately three square feet of coverage) and weighing approximately 25 pounds.

Paver System Overview

The polymeric material is formed into paver pieces and, in some embodiments, a mating interlocking substrate for underlying more than one paver piece. In some embodiments, described more fully below, the paver pieces are mating and interlocking with one another, thereby providing a self-substrate. The substrate, whether separate from or integral to the paver pieces, provides a positive locking system that prevents adjacent pavers from moving laterally relative to each other, provides a means to transfer and install multiple paver blocks at one time, and provides a means to disperse compression loads over a wide area. In various embodiments, the paver system provides a low-weight, efficiently-transportable, environmentally friendly, low-labor alternative to conventional cementitious or clay paver systems. In another embodiment, the paver system incorporates surface-to-ground drainage paths. Such paver system provides a means for water penetration, thus reducing and/or eliminating the need for costly and many times non-environmentally friendly run-off paths that are traditionally used with non-porous concrete and asphalt systems. In yet another embodiment, the paver system accommodates a conduit system filled with a variety of heating and/or coolant options (e.g., water, electric resistance cabling, etc.). The system provides a means to heat and/or cool the paver-substrate system, thus providing climate control of enclosed areas and surface temperature control of exterior areas.

Paver System Comprising Paver Pieces and Substrate

The paver system may comprise a plurality of paver pieces and a substrate. The substrates and paver pieces may be coupled with a laterally stabilizing interlock, with the one or more paver pieces interlocking with the one or more substrates. In the embodiments shown, the paver pieces span adjacent substrates. The paver pieces thereby effectively interlock the substrates. In alternative embodiments, one or more substrates may be configured to interlock with one another and/or the one or more paver pieces may be configured to interlock with one another.

Figure 2:
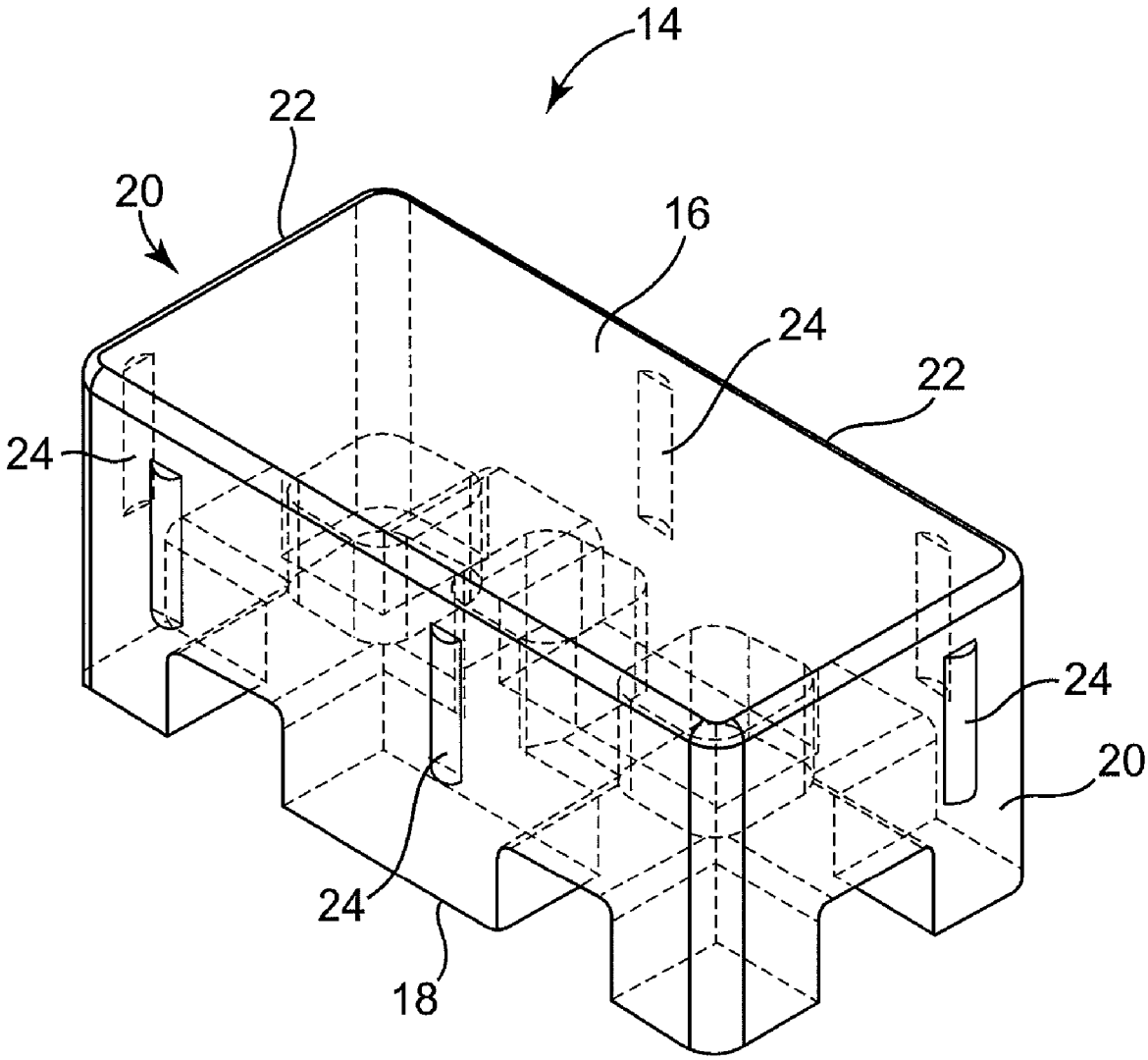
FIG. 2 is a top isometric perspective view of a paver piece in accordance with the embodiment of FIG. 1.
Figure 3:
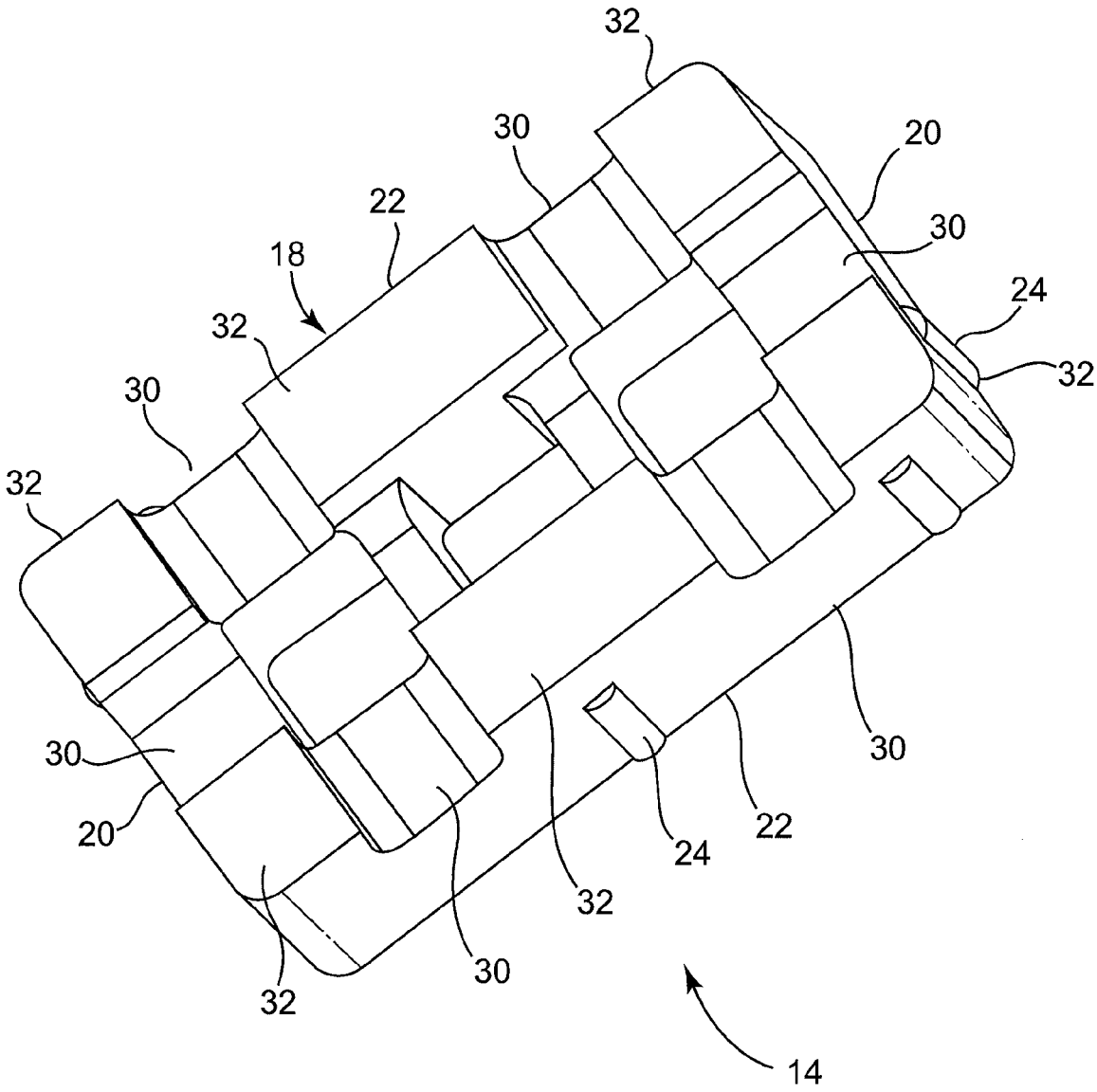
FIG. 3 is a bottom pictorial view of a paver piece in accordance with the embodiment of FIG. 1.
Figure 4:
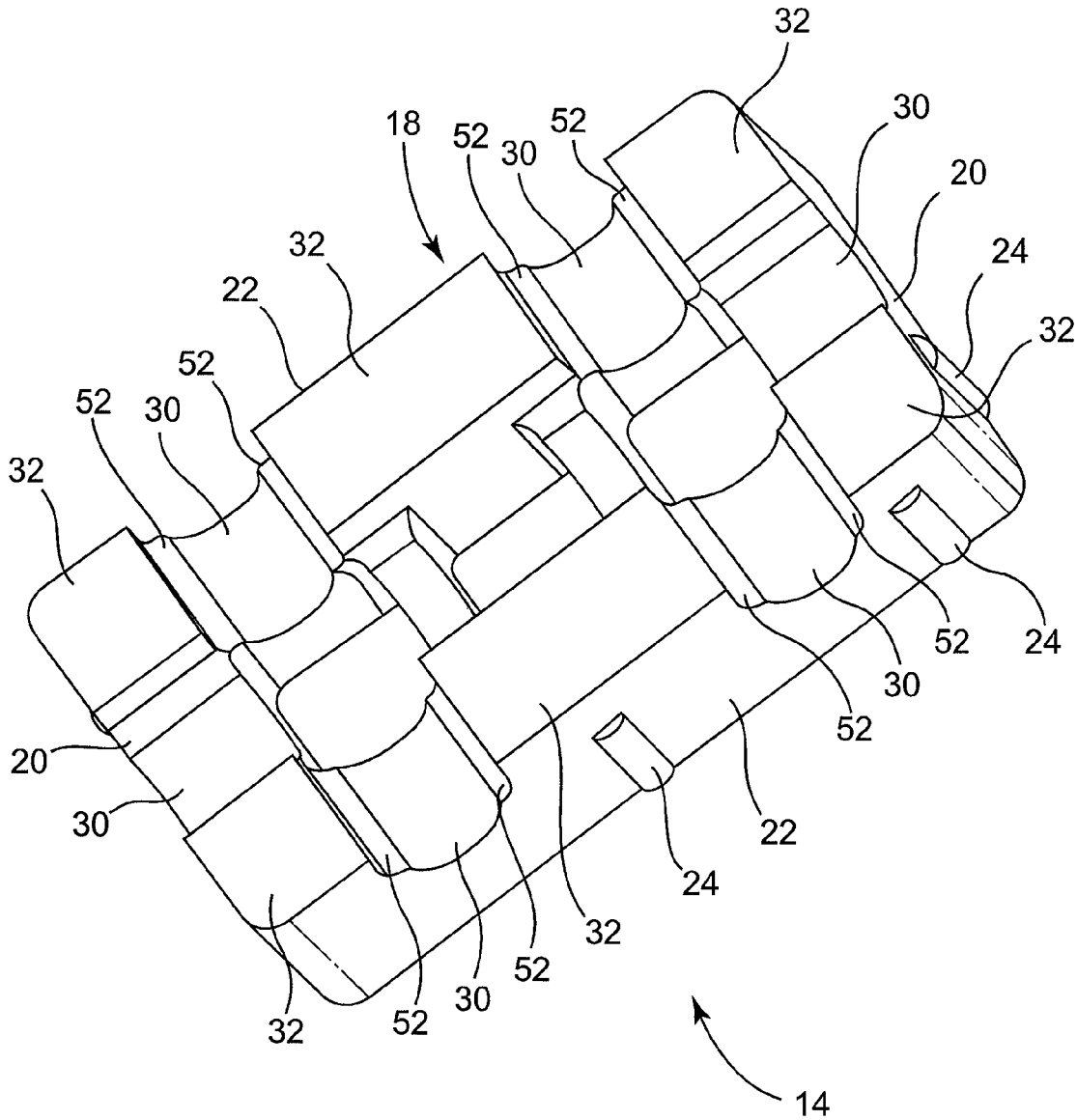
FIG. 4 is a bottom pictorial view of a paver piece having channels to receive a heating element in accordance with one embodiment.
Figure 5:
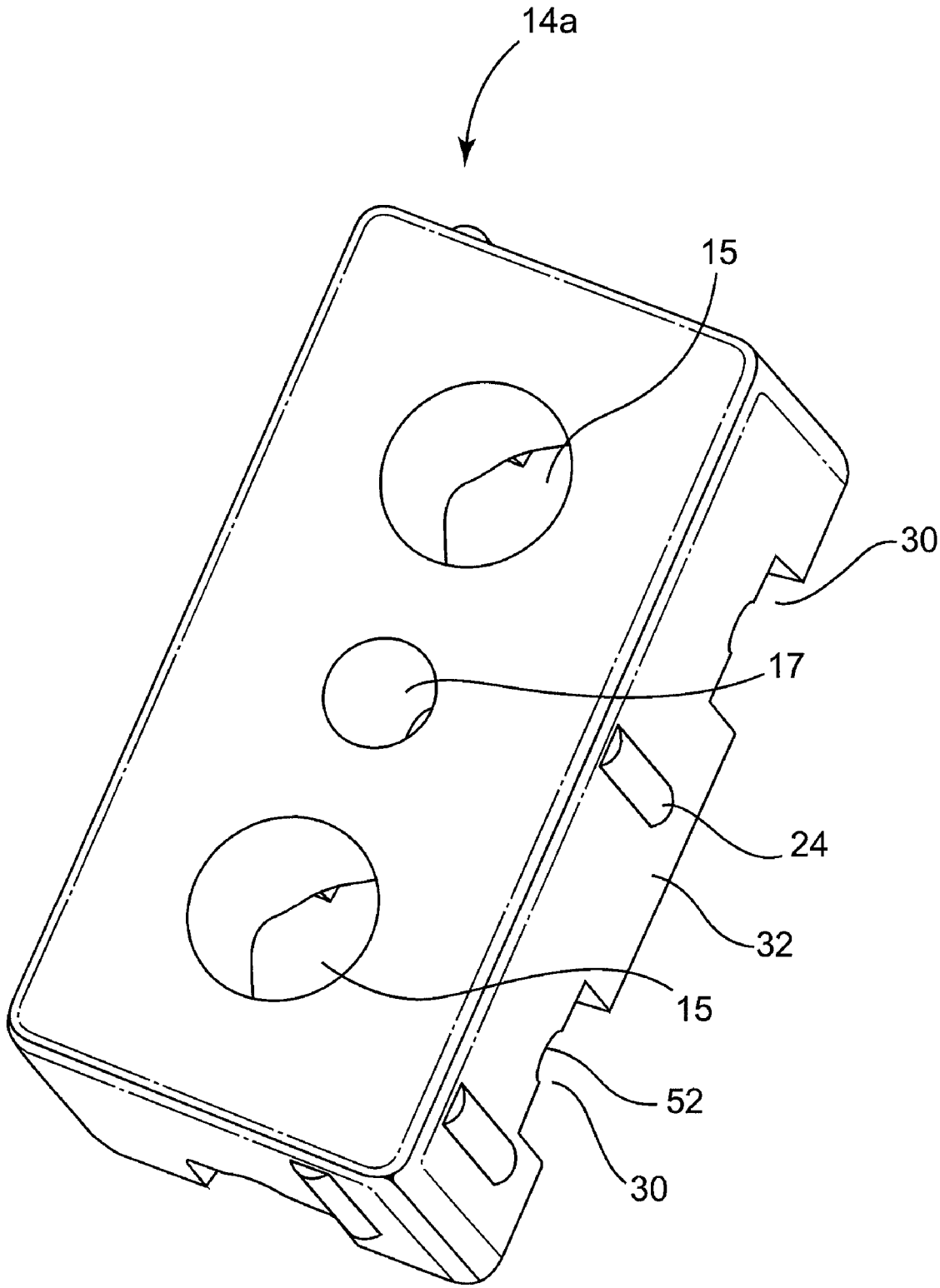
FIG. 5 is a top pictorial view of a paver piece in accordance with another embodiment.
Figure 6:
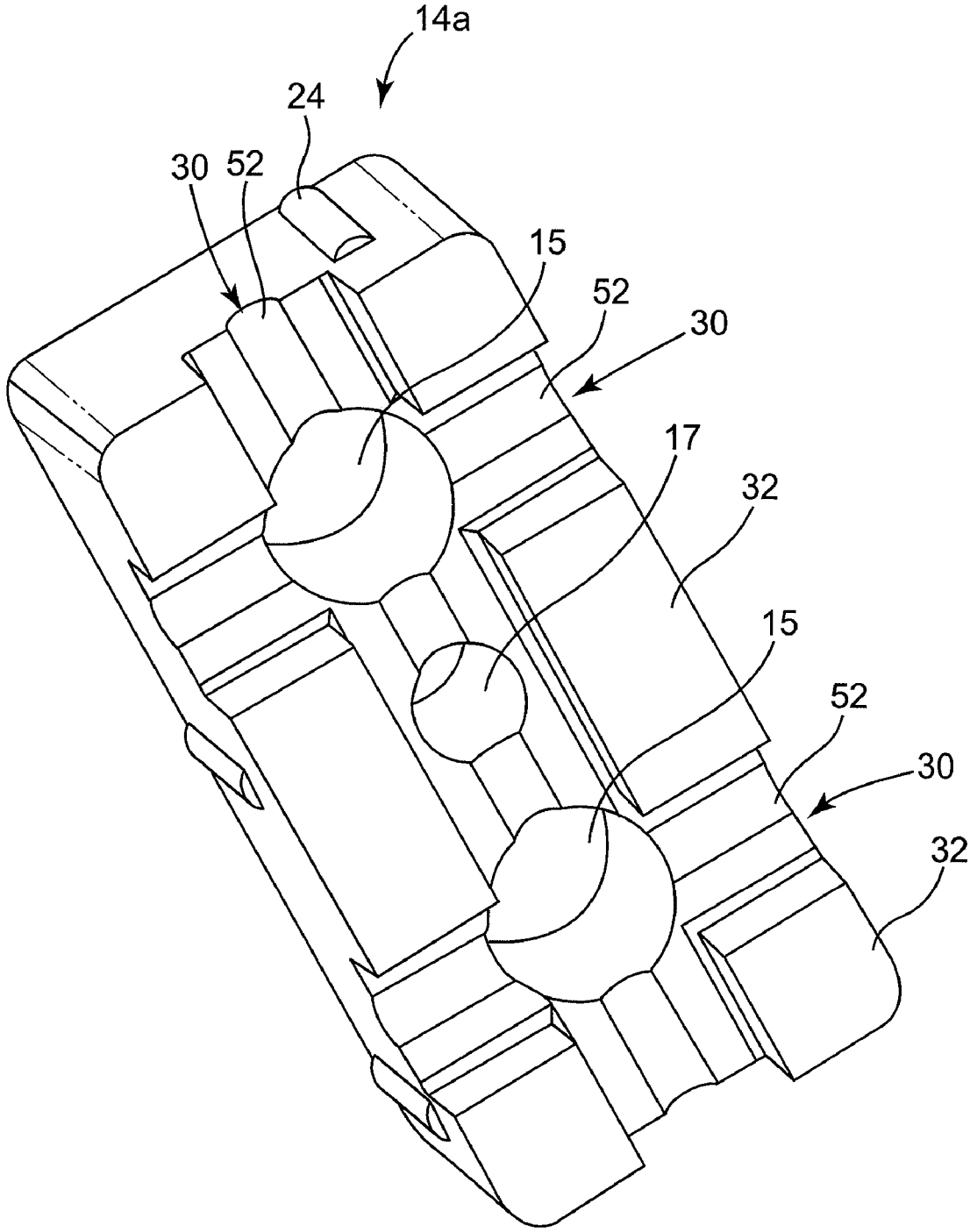
FIG. 6 is a bottom pictorial view of a paver piece in accordance with the embodiment of FIG. 5.
Figure 7:
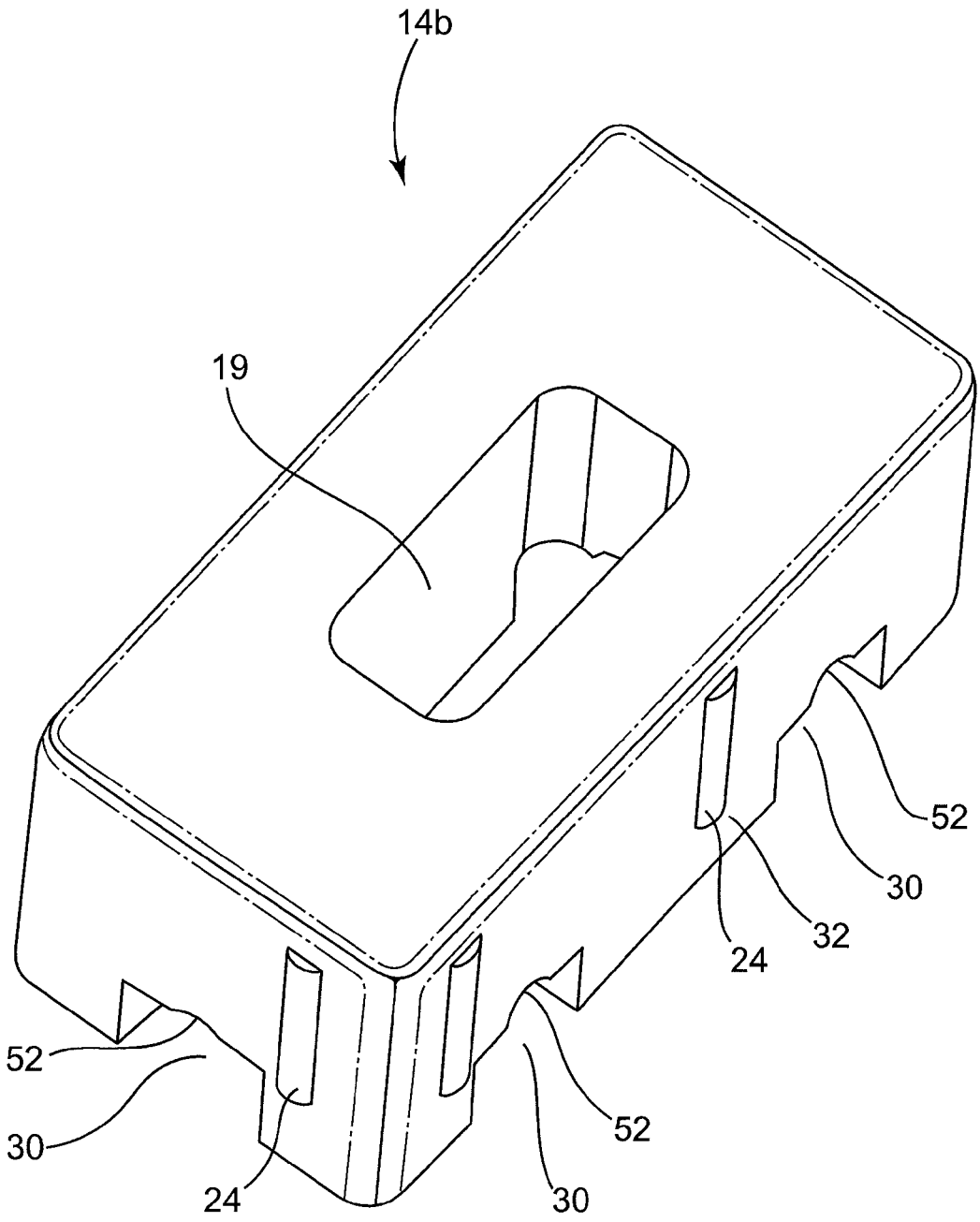
FIG. 7 is a top pictorial view of a paver piece in accordance with a further embodiment.

One embodiment of a paver piece 14 for coupling to a substrate 12 (shown in FIGS. 8*a*-8*c*) is shown in FIGS. 1-4. Alternative paver piece embodiments for coupling to a substrate 12 are shown in FIG. 5-7. FIGS. 1 and 2 illustrate a paver piece 14 from a top perspective. FIGS. 3 and 4 illustrate paver pieces 14 from a bottom perspective. In the embodiments shown, each paver piece 14 comprises a generally rectangular form. As will be understood by one skilled in the art, each paver piece 14 may be shaped in any manner with different geometric shapes, such as squares, hexagons, triangles, etc. that form interlocking surface patterns. The paver pieces include a coupling feature and the substrate includes a complementary coupling feature whereby the paver pieces mate with the substrate. This method provides lateral stability and may also, in some embodiments, provide a friction fit for vertical stability.

As shown, the rectangular paver piece 14 has a generally flat top surface 16 and a bottom surface 18. As described with reference to FIGS. 3 and 4, the bottom surface 18 is configured with features for coupling with at least one substrate 12. The paver piece 14 has front and end walls 20 and first and second side walls 22. As shown, two spacers 24 are provided on each of the first and second side walls 22 and one spacer 24 is provided on each of the front and end walls 20. In alternative embodiments, spacers may be otherwise provided or may not be provided. The spacers 24 provide, at least, space for sand-locking between paver pieces 14. Thus, after placement of the pavers pieces 14, sand may be distributed over the surface of the paver system and permitted to infiltrate between the paver pieces 14 by the spacing of the spacers 24, thereby enabling sand-locking of the paver pieces 14. The size of the spacers 24 may be varied to adjust the spacing of the paver piece. Generally such size variation must correspondingly include variation in the size of the paver piece not including the spacers or variation in the spacing of complementary features of the substrate for coupling to the paver piece. In some embodiments, the size of the spacers 24 may be increased to provide drainage pathways between pavers.

The top surface 16 of the paver piece 14 may be roughened or textured such that it helps deter slippage. Roughness/texture may be imparted to the top surface 16 via mold design, manual roughening, or may be inherent in the top surface 16 due to the material used, e.g. granules of recycled tire or other material. Further, in alternative embodiments, due to the formability of the polymeric material, the top surface 16 may be configured with different textures or designs including imprinted corporate logos, alphanumeric messages (e.g., address, name, website), decorative prints (e.g., leaf impressions, rough pebble surface) etc.

The bottom surface 18 of a paver piece 14 is shown in FIGS. 3 and 4. FIG. 3 illustrates a standard configuration while FIG. 4 illustrates a configuration having channels for receiving a heating element (described more fully below). The bottom surface 18 is configured for coupling with the at least one substrate 12 (see FIGS. 8*a*-8*c*). The configuration of the bottom surface 18 may assume a number of forms complementary to a substrate, including those shown and variations thereof. Thus, the paver piece 14 and the substrate 12 have complementary features for achieving coupling therebetween for lateral stability.

As shown, the bottom surface 18 of the paver piece 14 includes recesses 30 for receiving protrusions from the substrate 12 and protrusions 32 for receipt by the substrate 12. In alternative embodiments, the bottom surface 18 may include only protrusions for receipt by recesses in the substrate, may include only recesses for receipt of protrusions from the substrate, or may have other suitable configuration for coupling with the substrate. Thus, in various embodiments, the complementary coupling features may comprise male and female features. Either of the male or the female feature may be provided on either of the paver piece 14 or the substrate 12. In embodiments comprising a female feature on the substrate 12, the female feature may be closed or may be open, thus creating an opening through the substrate 12.

Figure 8A:
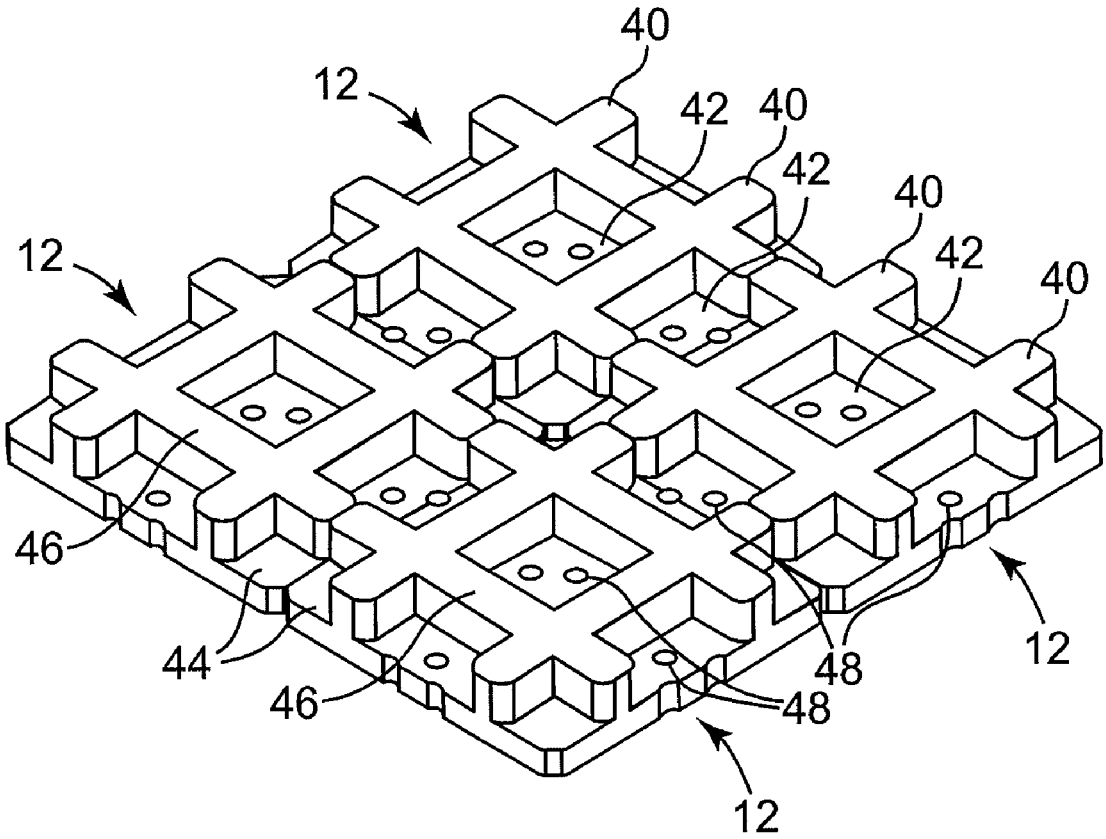
FIG. 8*a* is a pictorial view of a plurality of substrates, complementary with the paver pieces of FIGS. 1-7, in accordance with one embodiment.

The paver piece 14 may be provided in any suitable configuration so long as it is complementary with at least some feature of the substrate 12 to provide lateral stability to the paver pieces. It is to be noted that in addition to providing lateral stability of the paver pieces, lateral stability may be provided for adjacent substrates, discussed more fully below. Further, vertical stability may be imparted to the paver system by friction-fit of the paver pieces 14 on a substrate 12. Thus, for example, given a substrate 12 as shown in FIG. 8*a*, the paver piece 14 may alternately have any of the configurations of FIGS. 5-7. As shown in FIGS. 5 and 6, the paver piece 14*a* may include large openings 15 and a smaller central opening 17. Alternatively, as shown in FIG. 7, the paver piece 14*b* may include a single opening 19. The openings 15, 17, 19 may provide drainage through the paver piece 14.

Figure 9A:
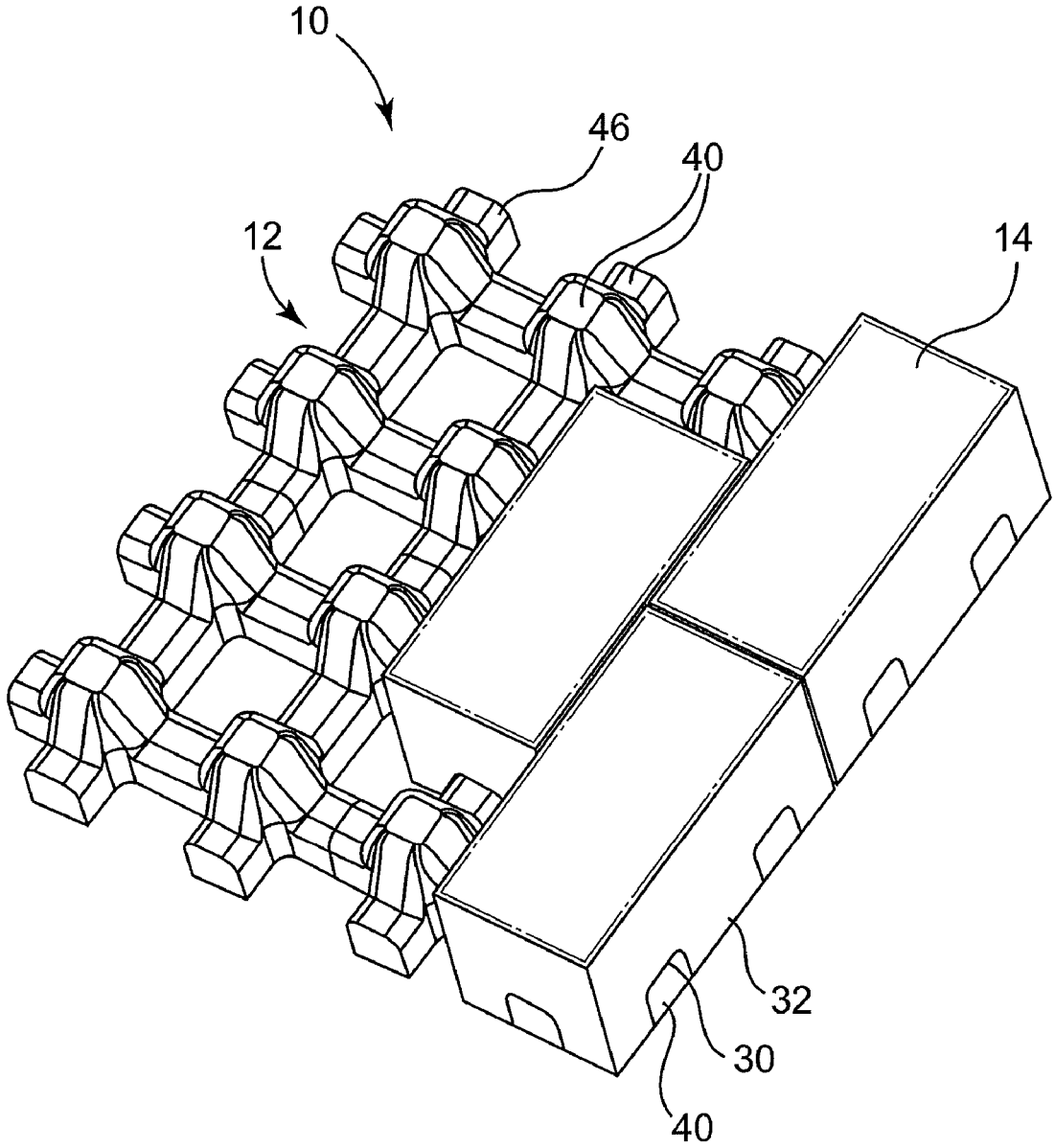
FIG. 9*a* is a pictorial view of a plurality of substrates with paver pieces of FIG. 1 coupled thereto in accordance with one embodiment.
Figure 9B:
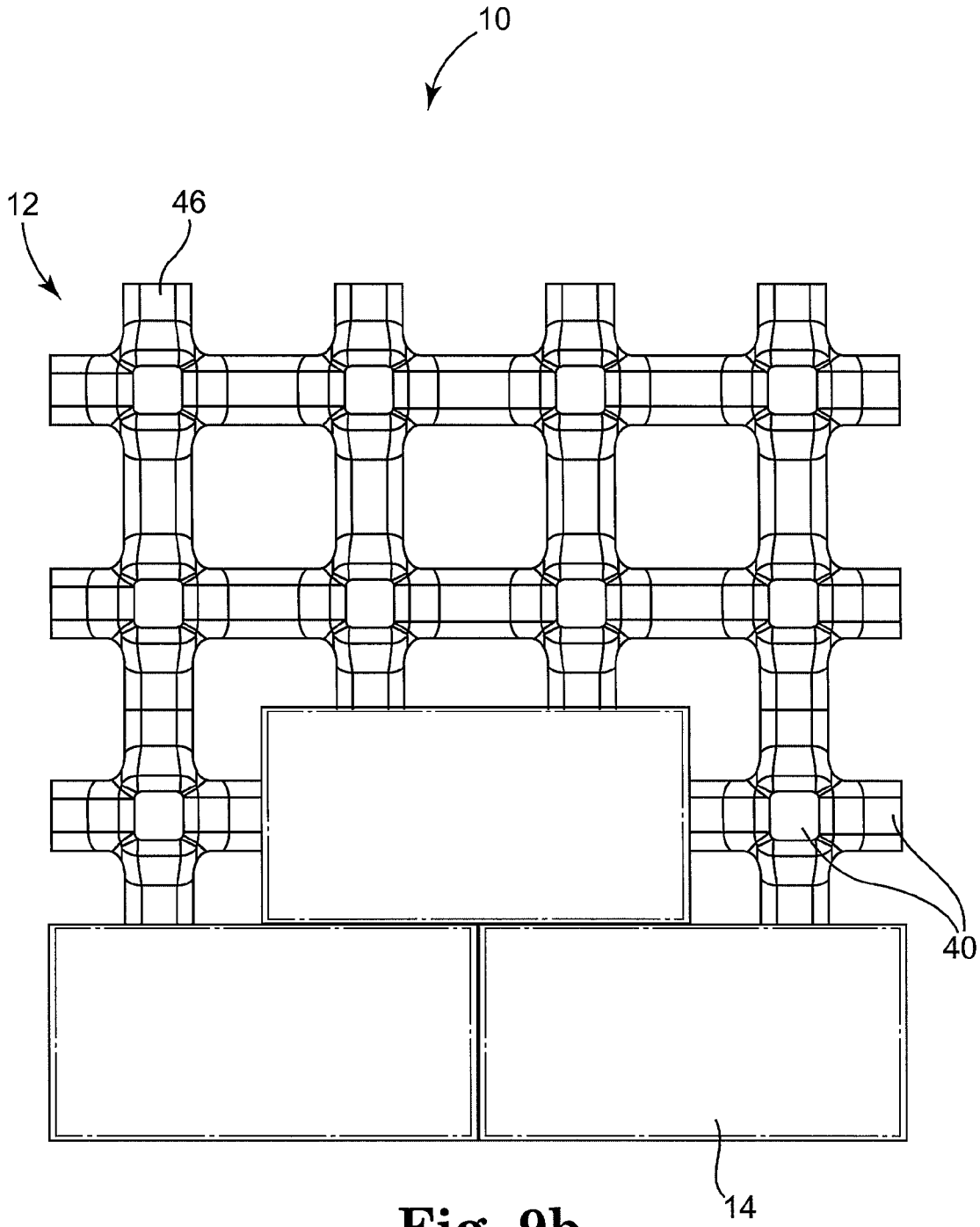
FIG. 9*b* is a top view of a plurality of substrates with paver pieces coupled thereto in accordance with the embodiment of FIG. 9*a*.

FIG. 8*a* illustrates a plurality of substrates 12. The substrates may be flexible to contour to a graded but not entirely flat surface. Alternatively, the substrates may be substantially rigid to better disperse a compressive load (as described below with reference to FIGS. 22 and 23). Each substrate 12 is configured for coupling with one or more paver pieces 14. The substrates 12 include protrusions 40 for receipt by recesses of the paver pieces 14. The substrates further include recesses 42 for receiving protrusions of the paver pieces 14. In the embodiment shown, the substrates 12 comprise a generally planar support 44 with a grid 46 provided thereupon. The planar support 44 and the grid 46 may be integrally formed. The structure of the grid 46 provides the protrusions 40 while the spacing in the grid 46 provides the recesses 42. In alternative embodiments, the substrates 12 may include only protrusions for receipt by recesses in the pavers, may include only recesses for receipt of protrusions from the paver pieces 14, or may have other suitable configuration for coupling with the paver pieces 14. In yet further embodiments, such as shown in FIGS. 9*a* and 9*b*, the substrate 12 may comprise open grids 46 without a continuous planar support surface.

As shown, a plurality of apertures 48 may be provided. Further, the apertures 48 provide drainage channels and reduce the overall weight of the substrate 12. The number of and placement of apertures 48 may be varied and, in some embodiments, no apertures may be provided.

Coupled Paver Pieces and Substrates

FIGS. 8*b* and 8*c*, 9*a* and 9*b*, and 10*a*, 10*b*, 10*c*, and 10*d* illustrate paver systems 10 comprising a plurality of substrates 12 with a plurality of paver pieces 14 coupled thereto. As shown, in the coupled relationship, the top surfaces 16 of the paver pieces 14 are in a closely spaced relationship substantially in a common plane and the paver pieces 14 cover substantially the entire substrate 12. In the embodiments shown, each of the paver pieces 14 and the substrates 12 comprise complementary recesses and protrusions for a mating relationship. Any suitable configuration for an interlocking relationship may be used. For example, in an alternative embodiment, overlapping paver pieces and substrates having a positive lock may be provided. Thus, as shown in FIGS. 11*a*, 11*b*, 11*c*, and 11*d*, the paver systems 10 may comprise a plurality of substrates 12 and paver pieces 14, wherein the substrates 12 include guides 61 and the paver pieces 14 include complementary edges 63. In the embodiment of FIGS. 11*a* and 11*b*, the guides 61 are substantially continuous over the substrate 12. Thus, the paver pieces 14 may generally only be placed in one orientation. In contrast, in the embodiment of FIGS. 11*c* and 11*d*, the guides 61 are discrete and the paver pieces 14 may be placed therebetween in any suitable orientation.

In each of the embodiments shown other than FIGS. 11*a*-11*d*, the paver pieces 14 are placed on the substrates 12 with protrusions of the substrates 12 (formed by the grid of the substrate) received in recesses of the paver pieces 14 and protrusions of the paver pieces 14 received by recesses of the substrates 12 (formed by the spacing of the grid). In various embodiments, coupling may optionally be affected via pressure fitting, friction fit, or may further include an adhesive applied to either or both of the substrates 12 and the pavers 14. As shown, the orientation of the paver pieces 14 on the substrates 12 may be varied and may include, for example, orientation along the x-axis or along the y-axis. As seen most clearly in FIG. 8*c*, the paver pieces 14 may be oriented on the substrates 12 such that one or more paver pieces 14 span more than one substrate. Thus, for example, paver piece 14*c* spans substrates 12*a* and 12*b* while paver pieces 14*d* spans substrates 12*a* and 12*c*. The paver pieces 14 thereby effectively interlock the substrates 12 for lateral stability.

Figure 8B:
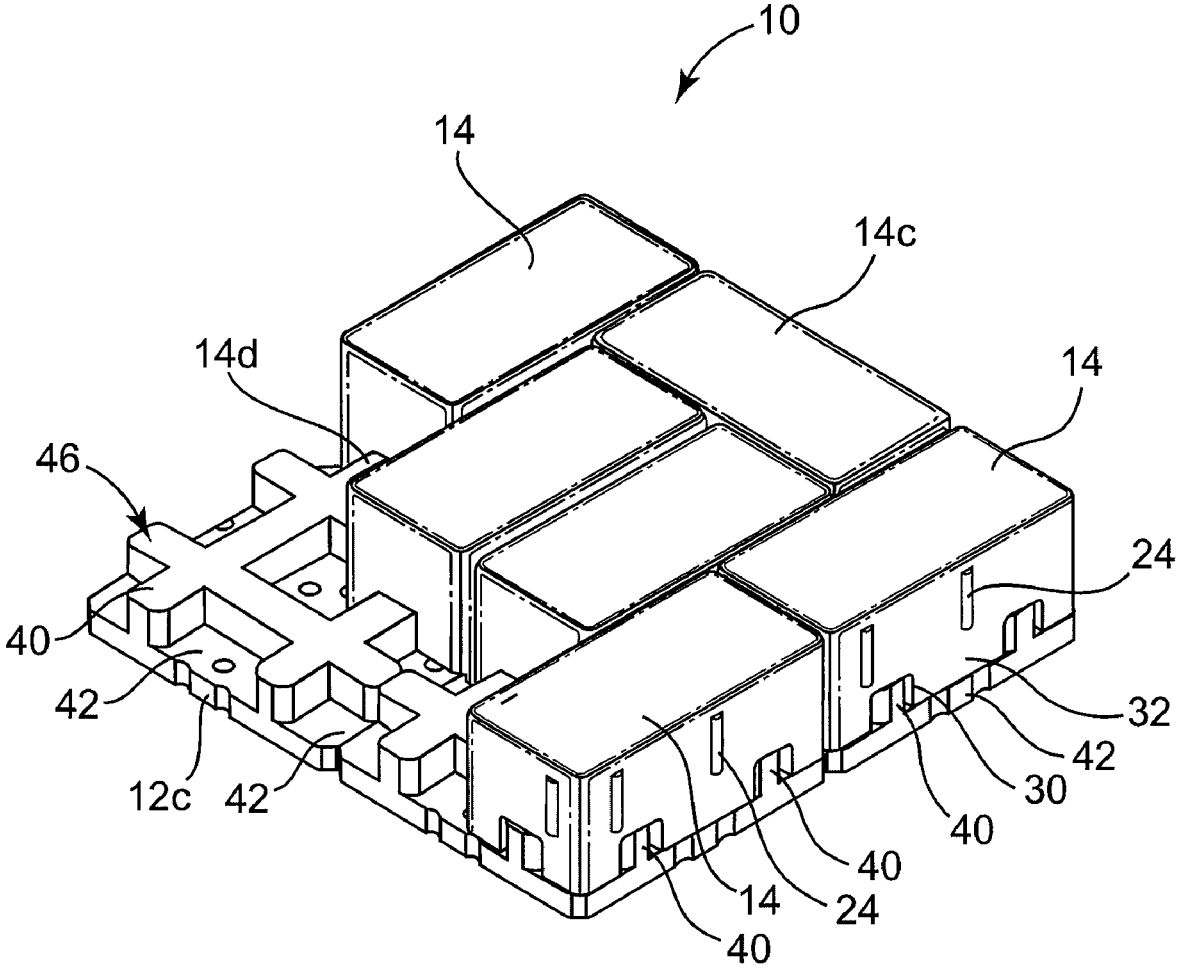
FIG. 8*b* is a pictorial view of a plurality of substrates with paver pieces of FIG. 1 coupled thereto in accordance with one embodiment.
Figure 8C:
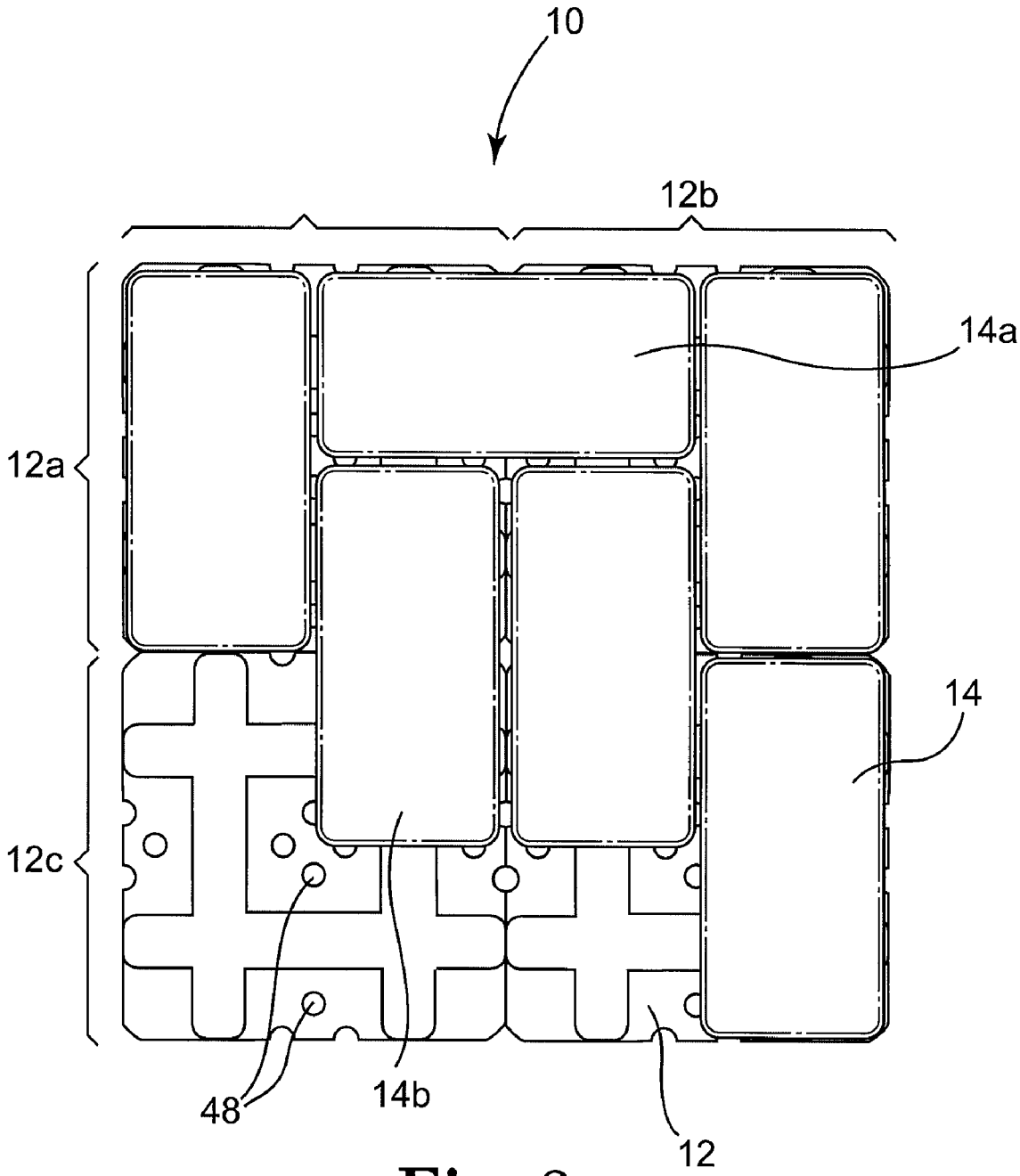
FIG. 8*c* is top view of a plurality of substrates with paver pieces coupled thereto in accordance with the embodiment of FIG. 8*b*.
Figure 10A:
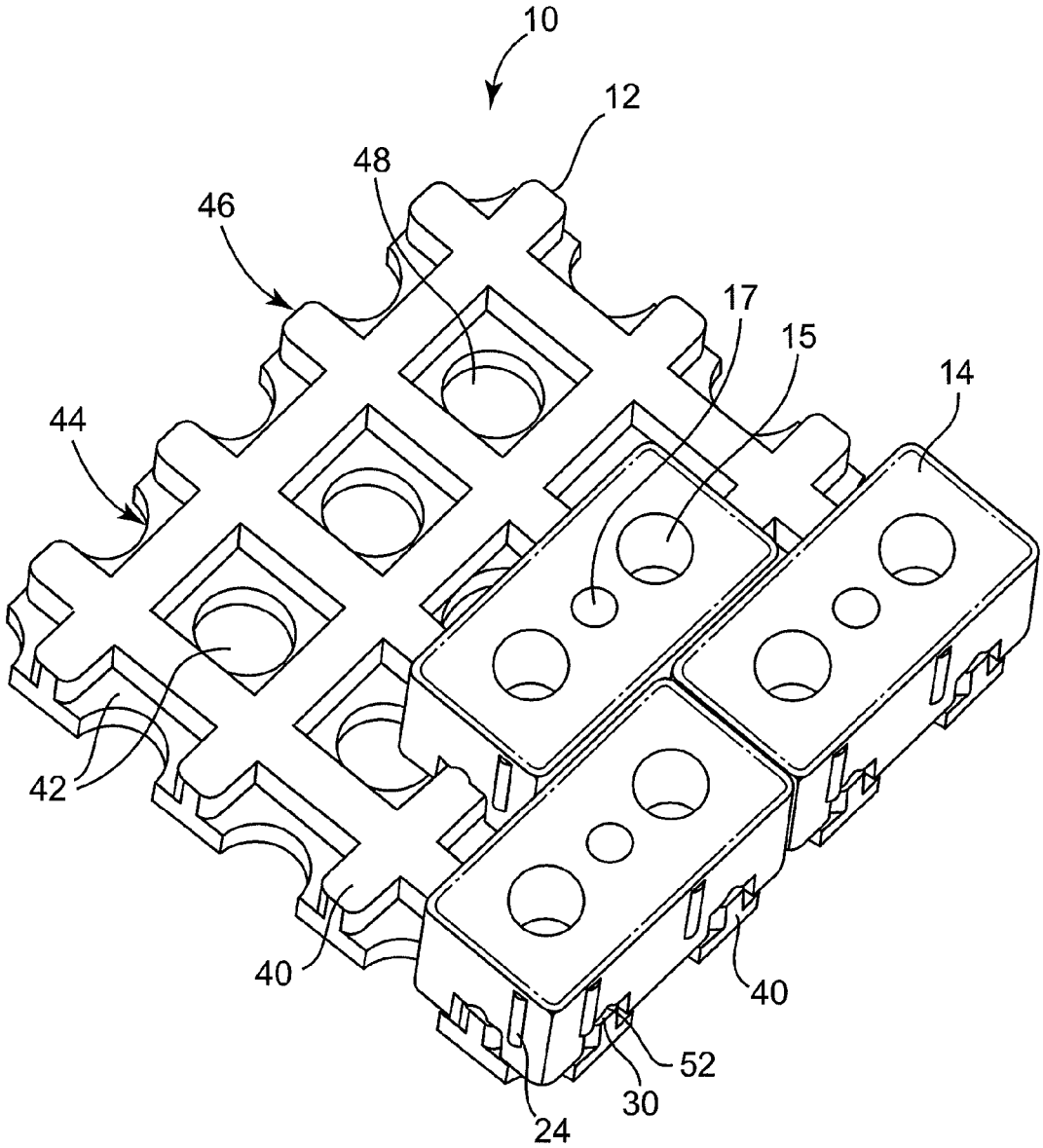
FIG. 10*a* is a pictorial view of a plurality of substrates with paver pieces of FIG. 5 coupled thereto in accordance with one embodiment.
Figure 10B:
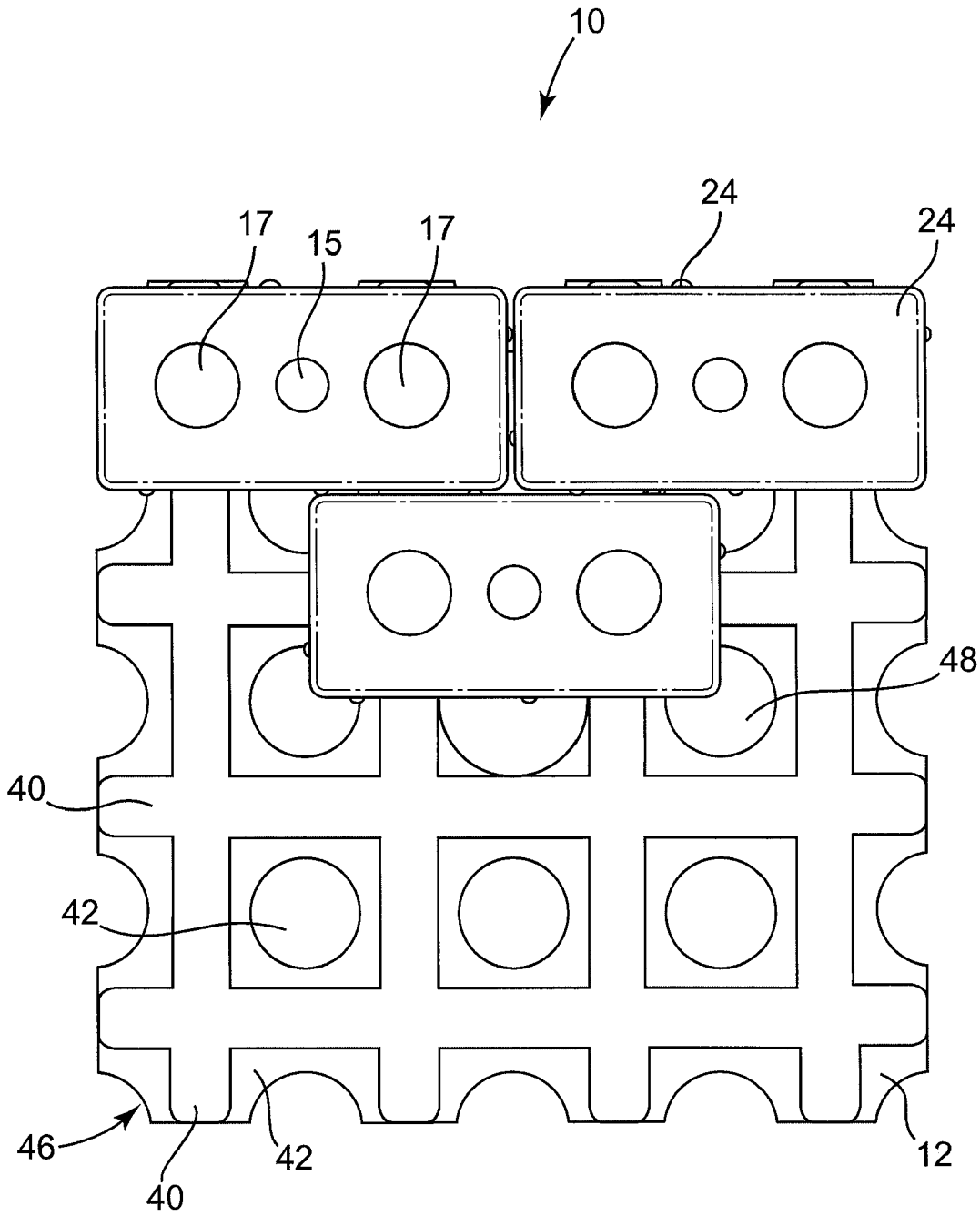
FIG. 10*b* is top view of a plurality of substrates with paver pieces coupled thereto in accordance with the embodiment of FIG. 10*a*.
Figure 10C:
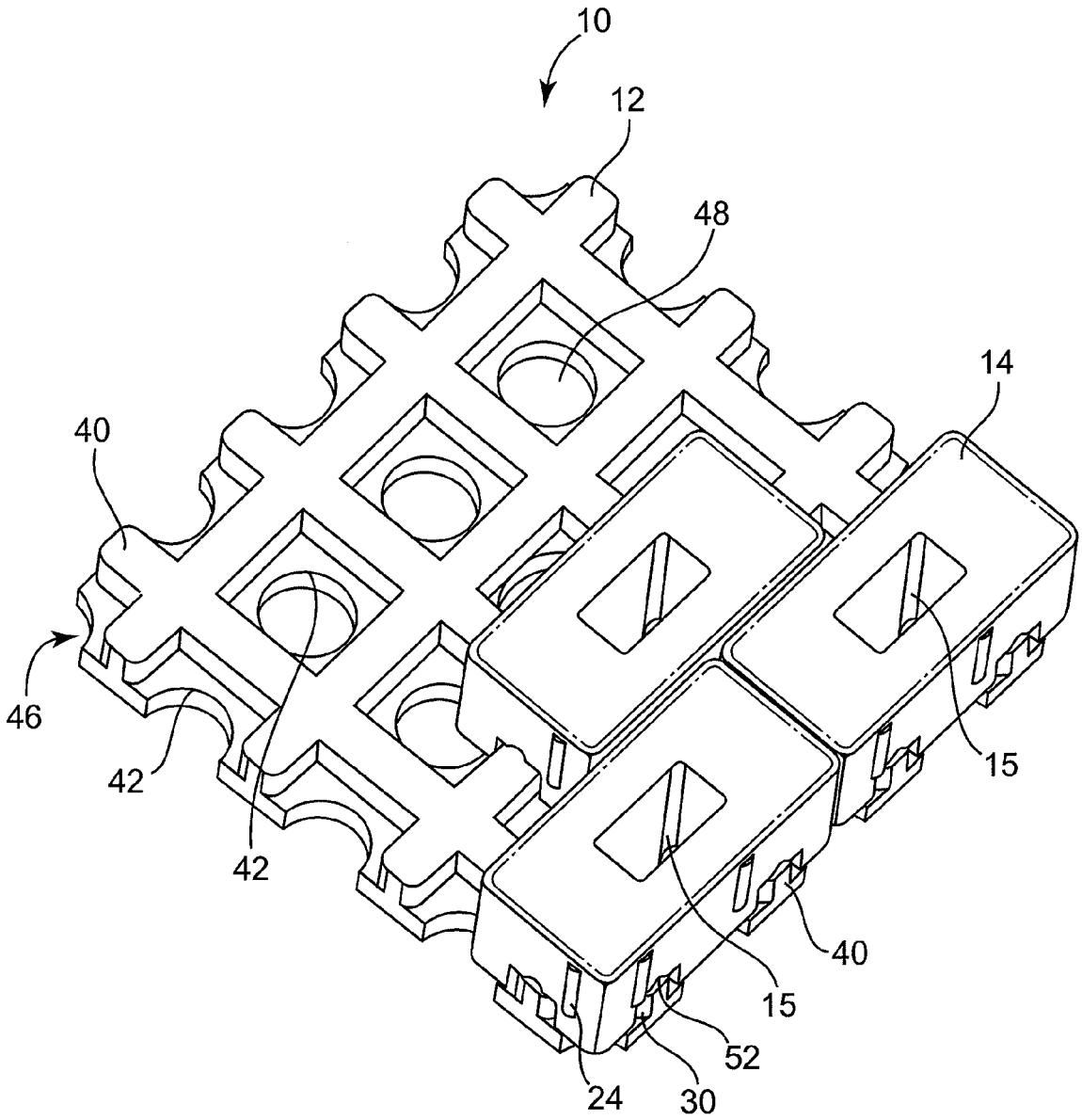
FIG. 10*c* is a pictorial view of a substrate with paver pieces of FIG. 7 coupled thereto in accordance with one embodiment.
Figure 10D:
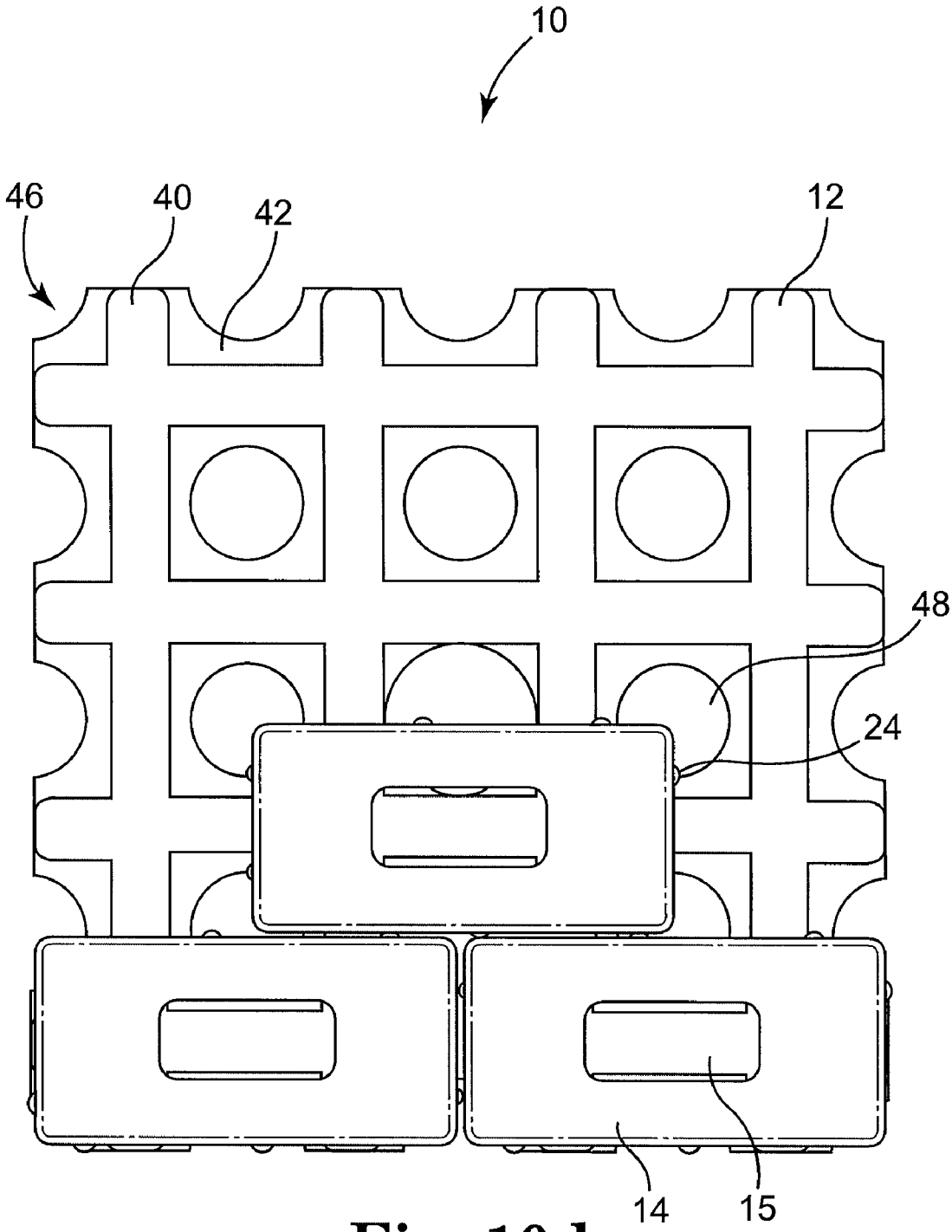
FIG. 10*d* is top view of a substrate with paver pieces coupled thereto in accordance with the embodiment of FIG. 10*a*.
Figure 11A:
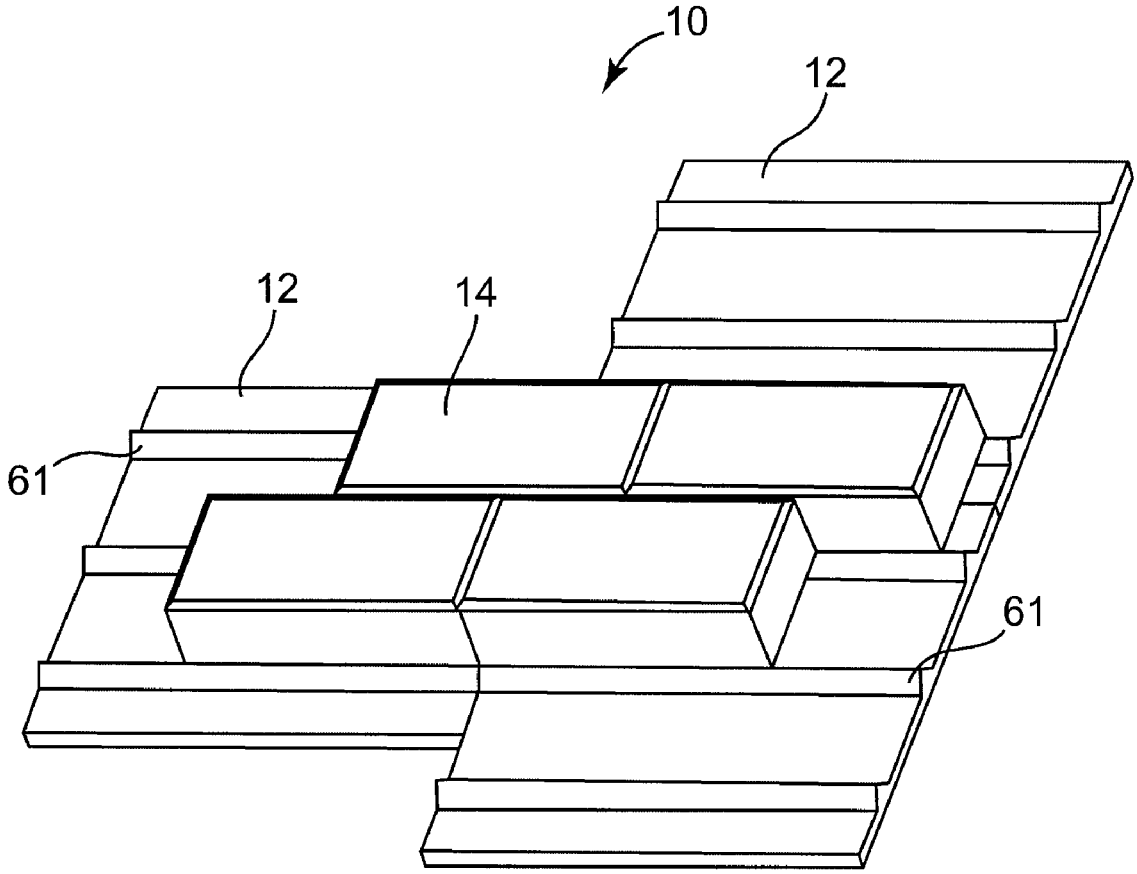
FIG. 11*a* is a pictorial view of a paver system comprising a plurality of substrates and paver pieces in accordance with one embodiment.
Figure 11B:
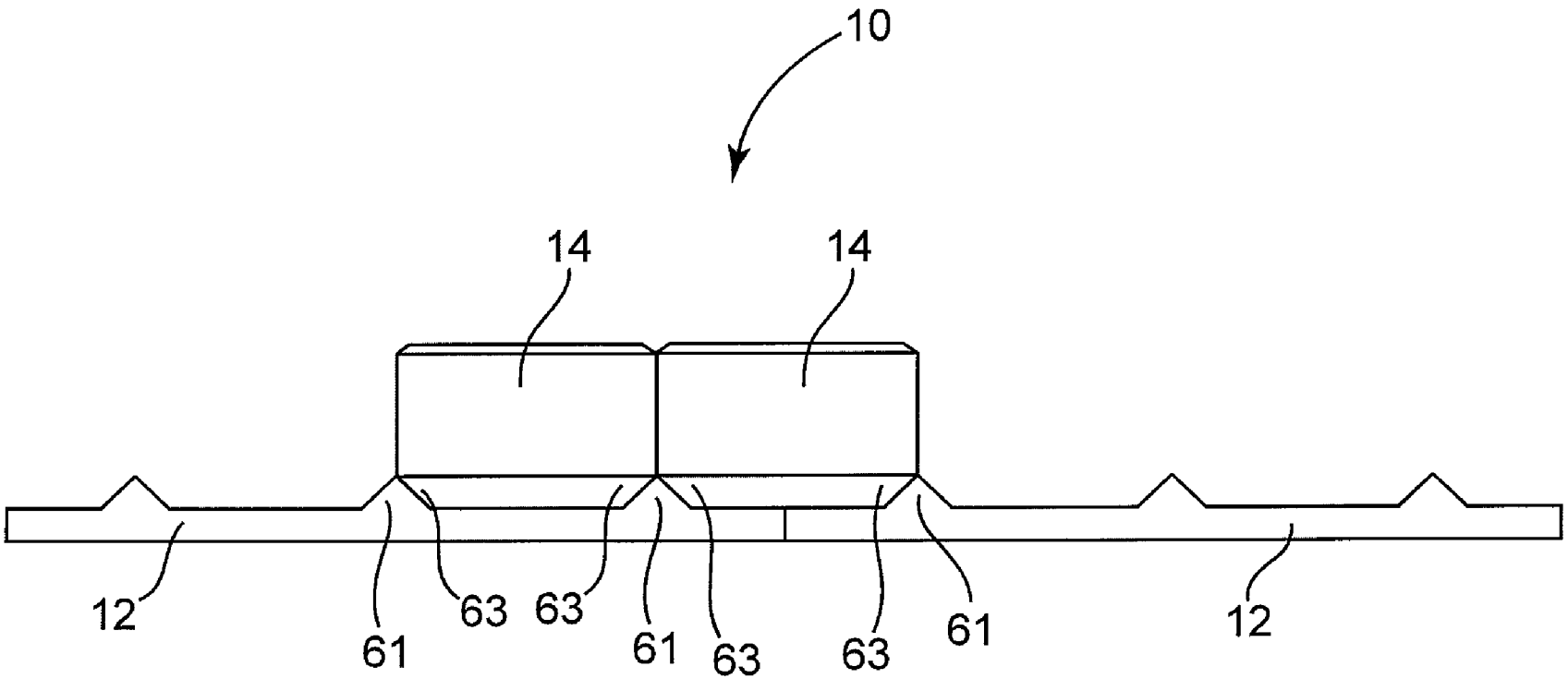
FIG. 11*b* is a side view of the embodiment of FIG. 11*a*.
Figure 11C:
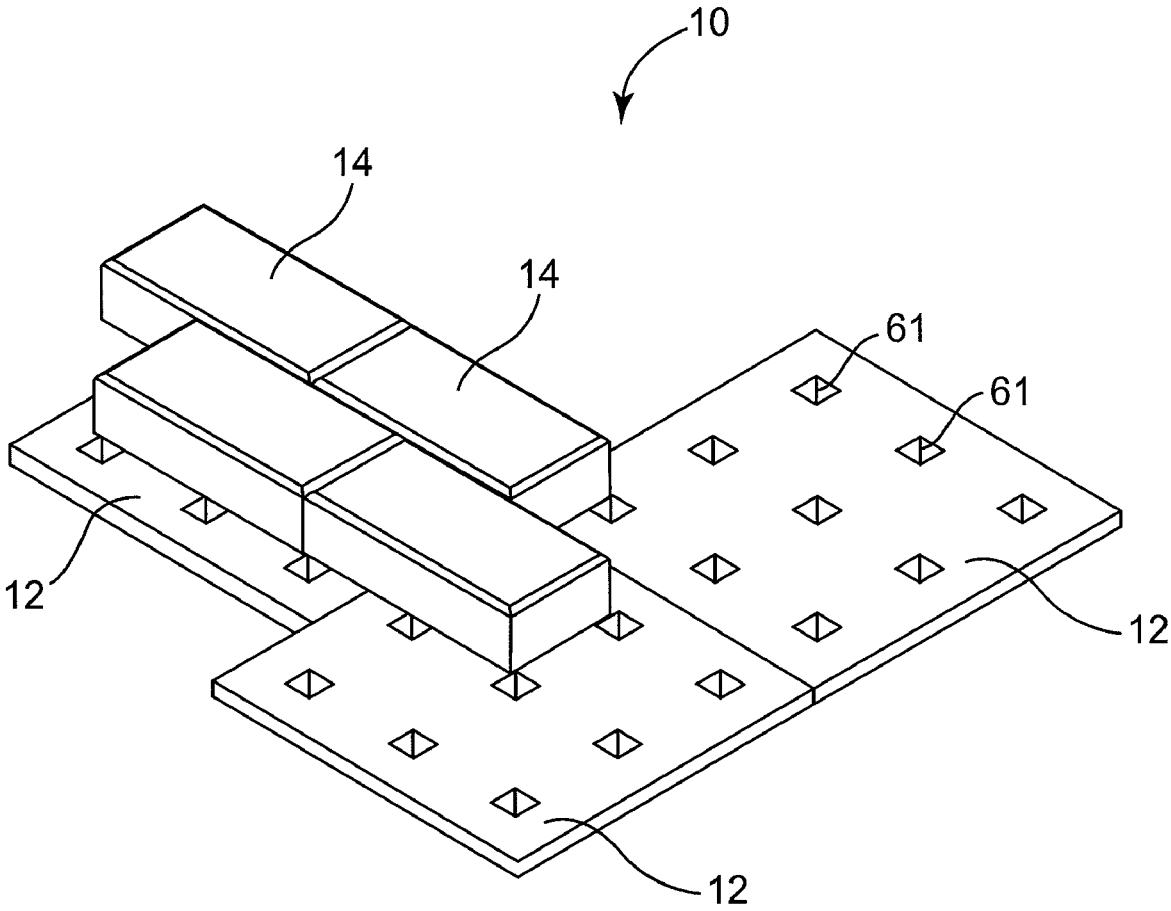
FIG. 11*c* is a pictorial view of a paver system comprising a plurality of substrates and paver pieces in accordance with one embodiment.
Figure 11D:
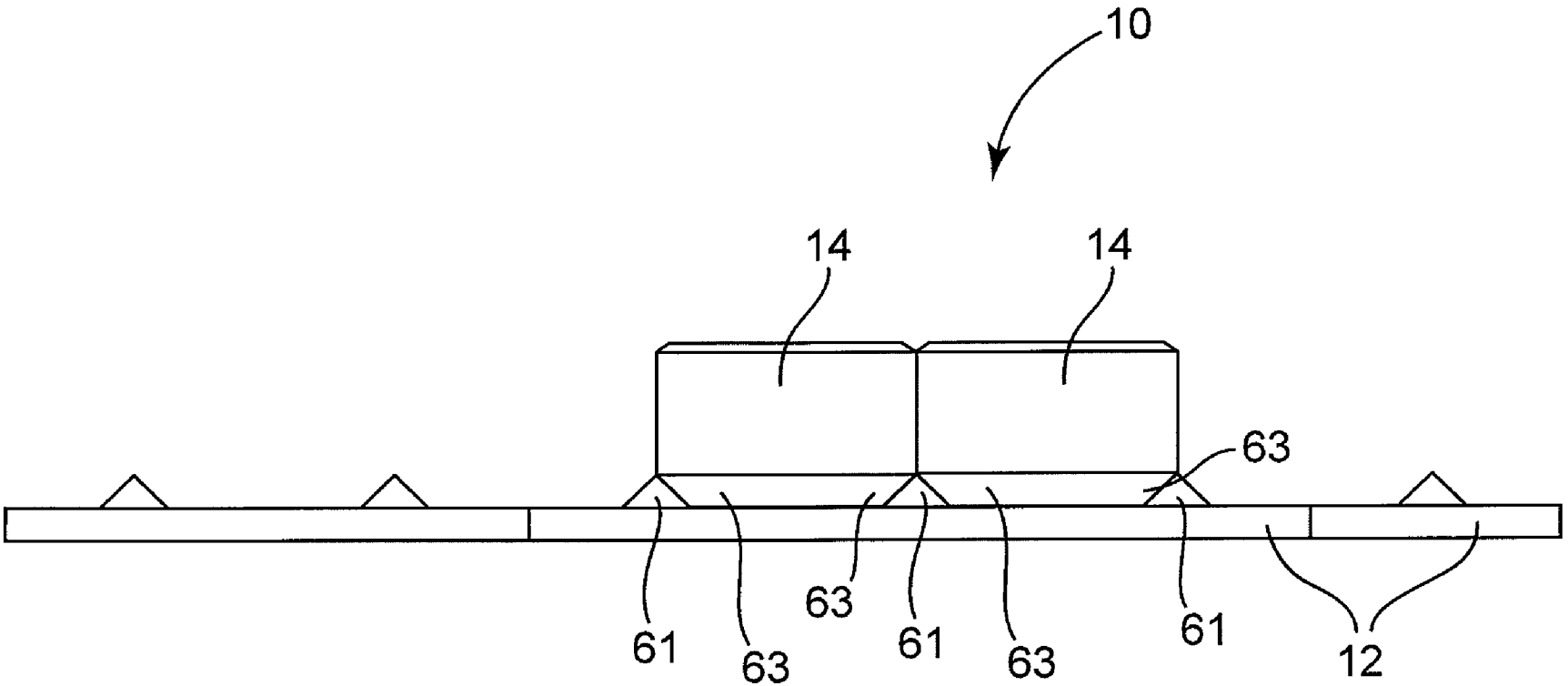
FIG. 11*d* is a side view of the embodiment of FIG. 11*c*.
Figure 12A:
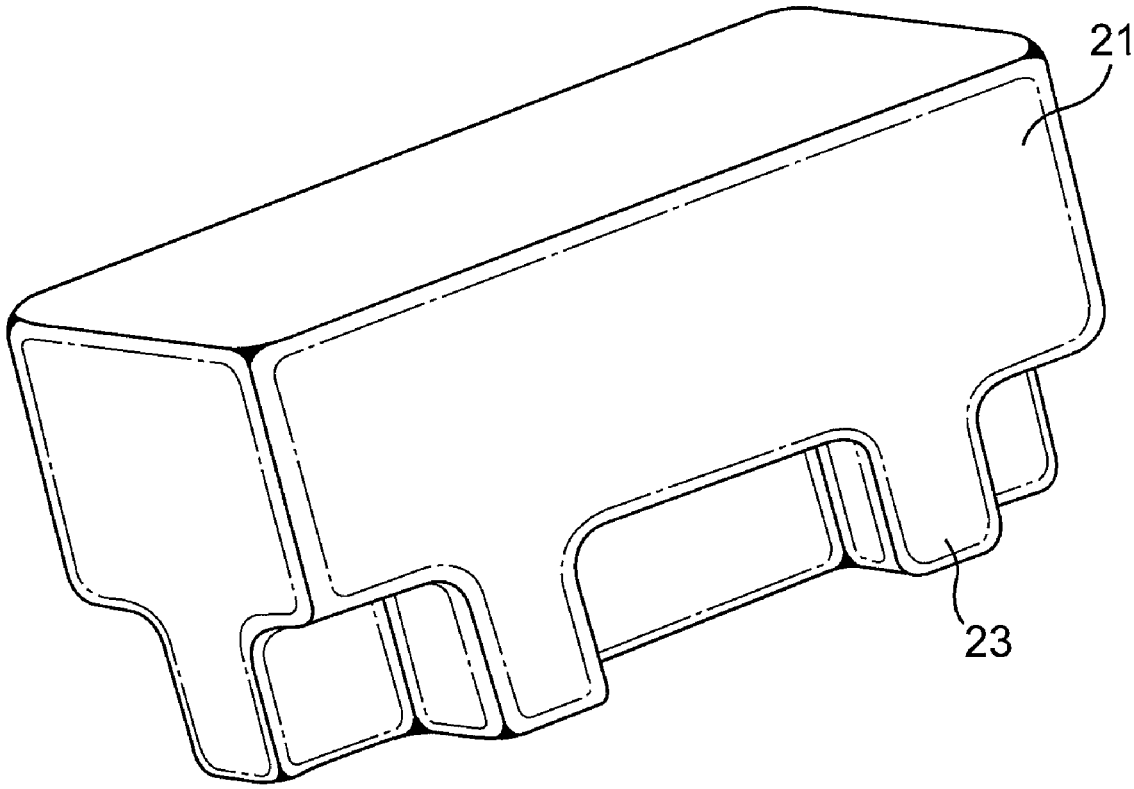
FIG. 12*a* is a side pictorial view of a paver piece in accordance with yet another embodiment.
Figure 12B:
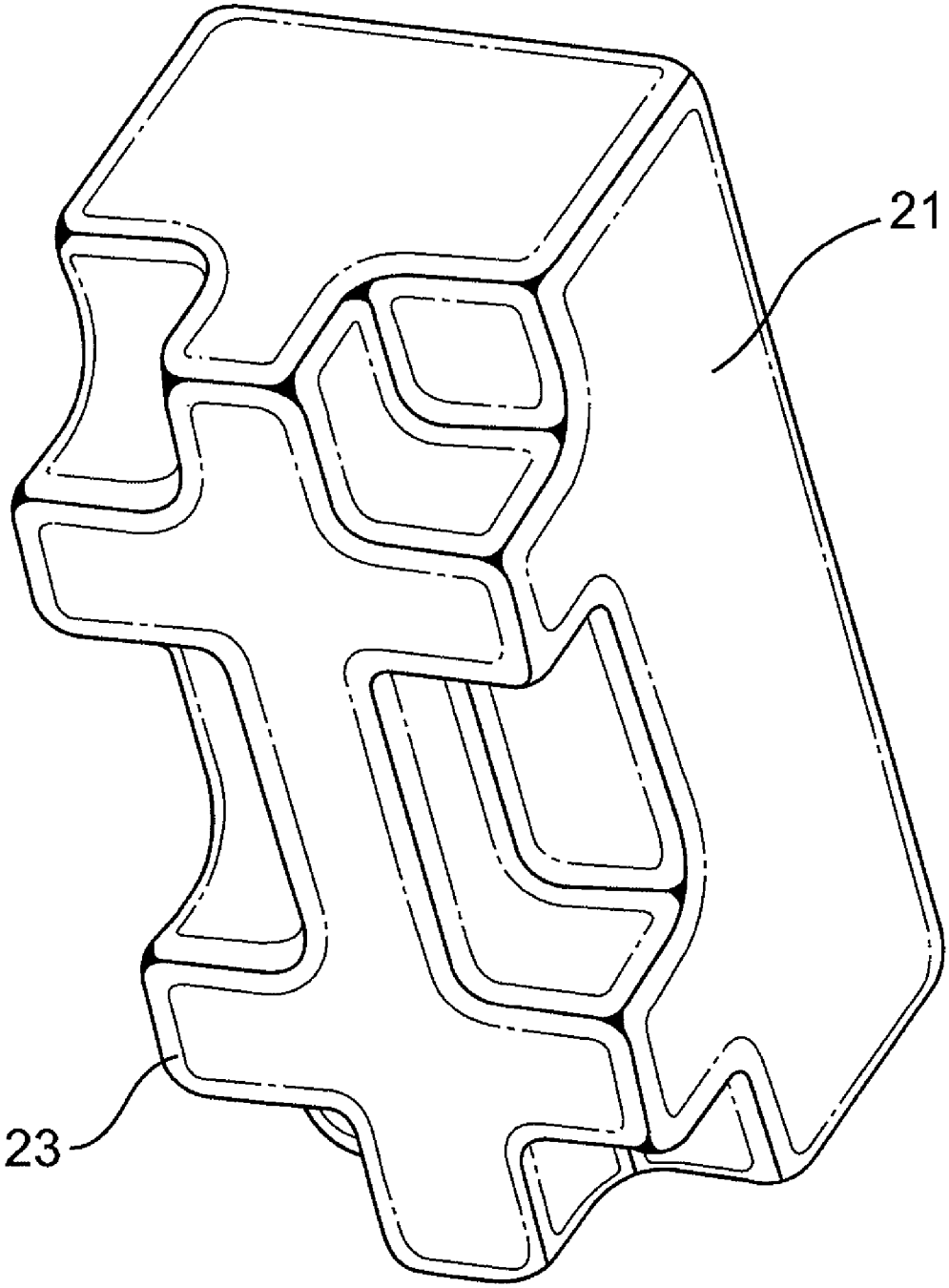
FIG. 12*b* is a bottom pictorial view of the paver piece of FIG. 12*a*.

FIGS. 10*a*, 10*b*, 10*c*, and 10*d* illustrate alternative embodiments to the embodiment of FIGS. 8*b* and 8*c*. FIGS. 10*a* and 10*b* illustrate the paver pieces of FIGS. 5 and 6 coupled to substrates having large drainage holes or apertures 48 therein. FIGS. 10*c* and 10*d* illustrate the paver pieces of FIG. 7 coupled to substrates having large drainage holes or apertures 48 therein. The drainage holes or apertures 48 aid in permeability of the paver system 10. These may be used in areas less likely to encounter foot traffic or areas requiring more drainage, such as the low corner of a larger paved area. Additionally, the apertures 15 of the paver pieces 14 may have varied configurations. FIGS. 10*c* and 10*d* illustrate an embodiment wherein the apertures 15 are configured as large rectangular openings.

Alternative Embodiments of Coupled Paver Pieces and Substrates

Figure 13:
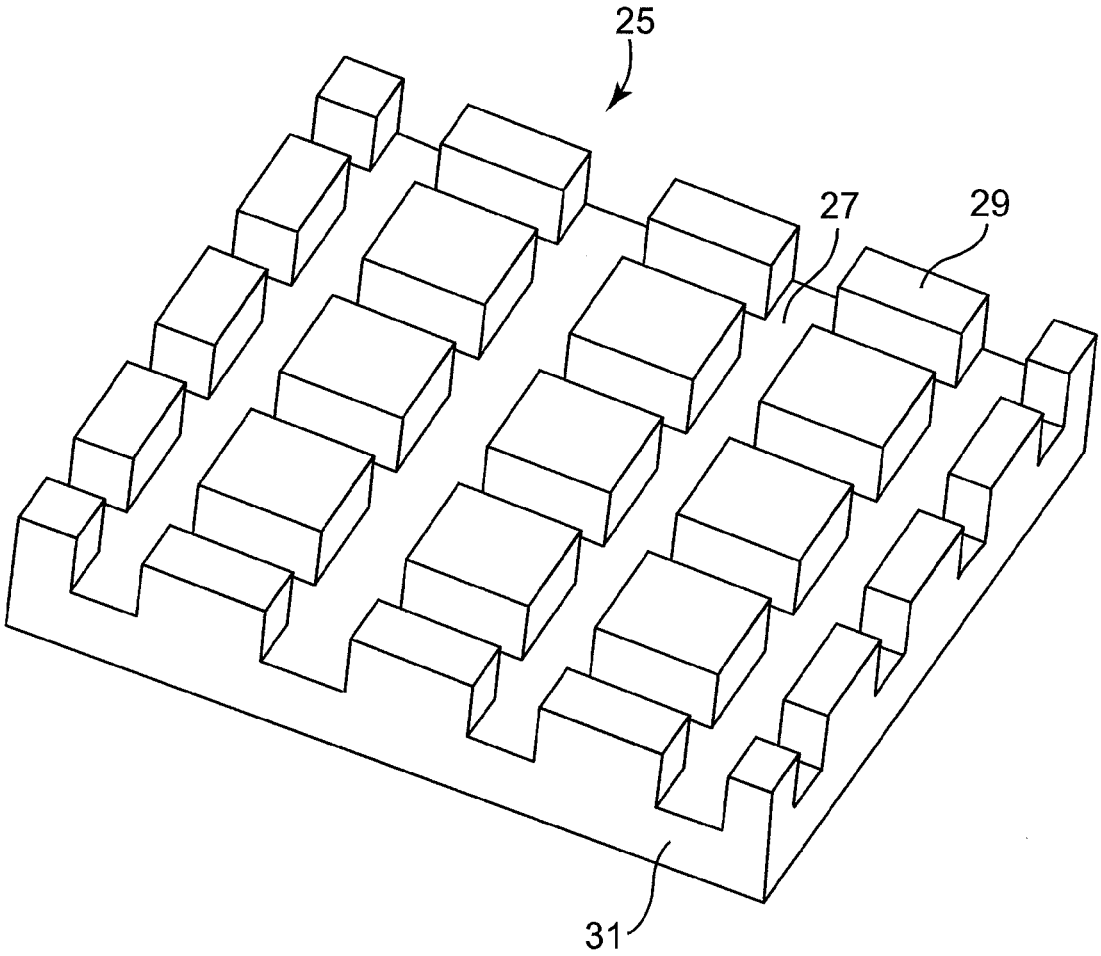
FIG. 13 is a top pictorial view of a substrate complementary with the paver piece of FIGS. 12*a* and 12*b* in accordance with one embodiment.
Figure 14:
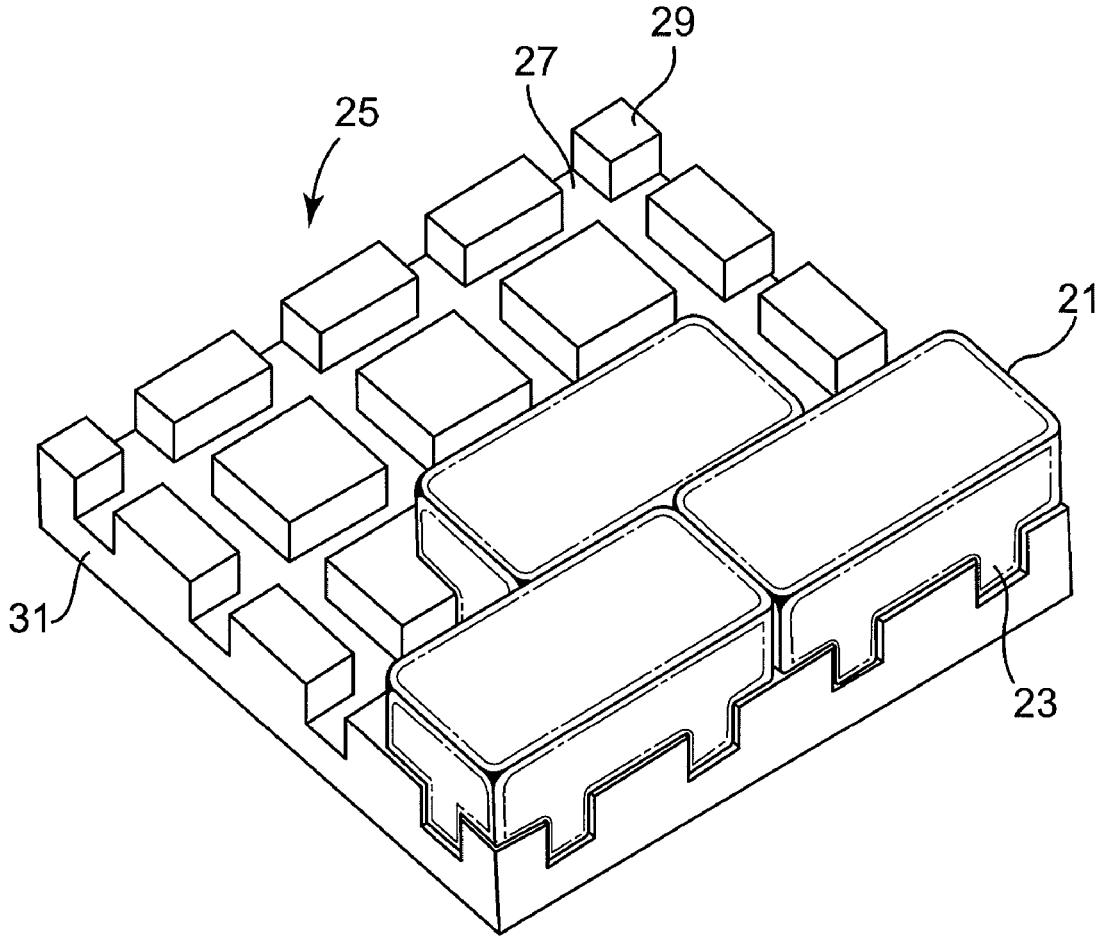
FIG. 14 is a top pictorial view of a substrate of FIG. 13 with paver pieces of FIGS. 12*a* and 12*b* coupled thereto.

FIGS. 11-14 illustrate a further embodiment of coupled paver pieces and substrates. FIGS. 12*a* and 12*b* illustrate an alternative paver piece 21. FIG. 13 illustrates a complementary alternative substrate. FIG. 14 illustrates paver pieces as shown in FIGS. 12*a* and 12*b* coupled with a substrate as shown in FIG. 13. As seen most clearly in FIG. 12*b*, the paver piece 21 includes a cross coupling structure 23 on its bottom surface. In the embodiment shown, the cross coupling structure 23 protrudes from the paver piece 21 for receipt by a complementary recess pattern of the substrate 25. The substrate 25, shown in FIG. 13, is configured for coupling with one or more paver pieces 21. The substrates 21 include protrusions 29, coupling recesses 27 being formed by the protrusions 29. The recess 27 receive the cross coupling structure 23 of the paver pieces 21. As shown, the substrates 21 comprise a generally planar support 31 with the protrusions 29 provided thereupon. The planar support 31 and protrusions 29 may be integrally formed.

Figure 15:
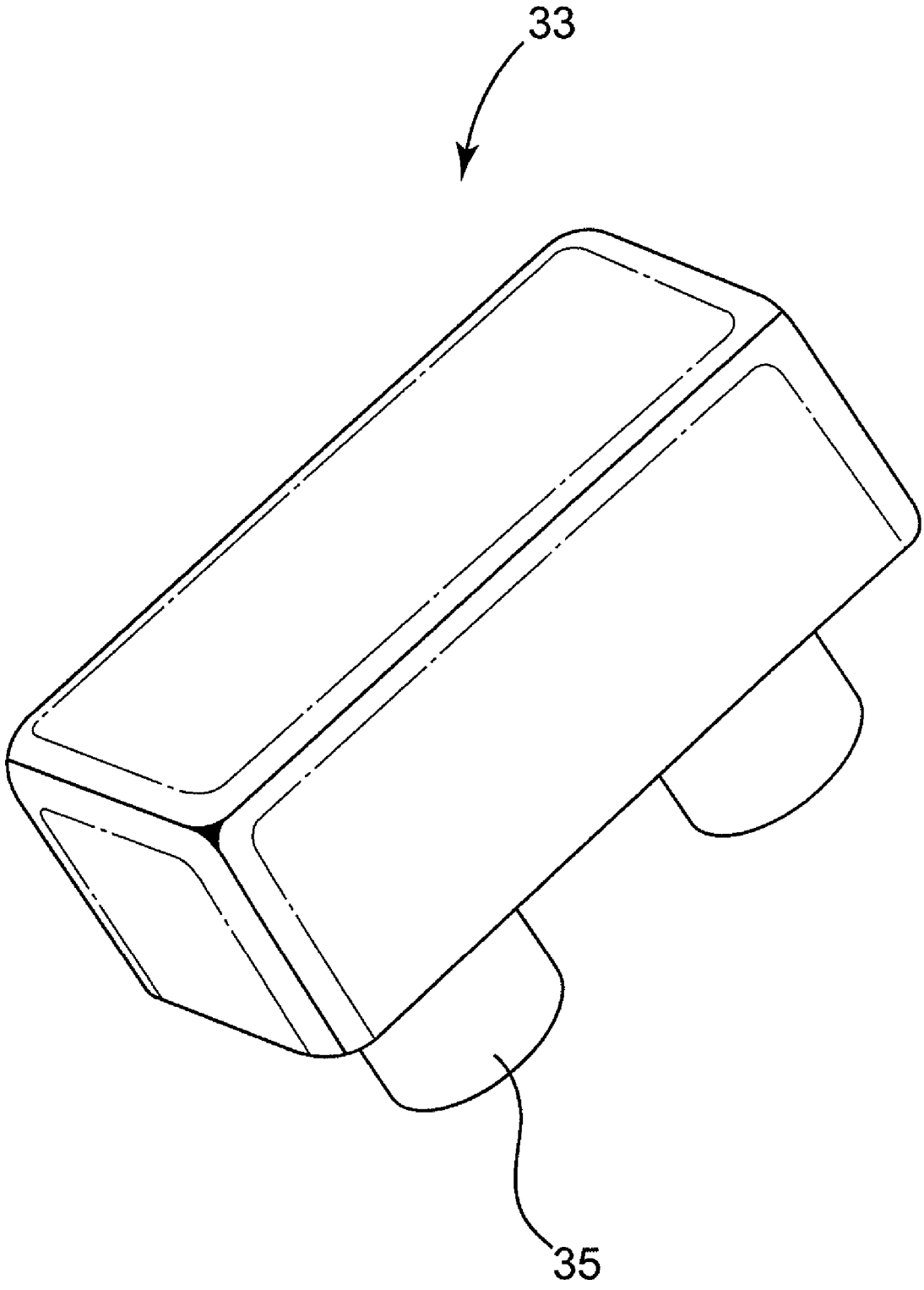
FIG. 15 is a side pictorial view of a paver piece in accordance with yet a further embodiment.
Figure 16:
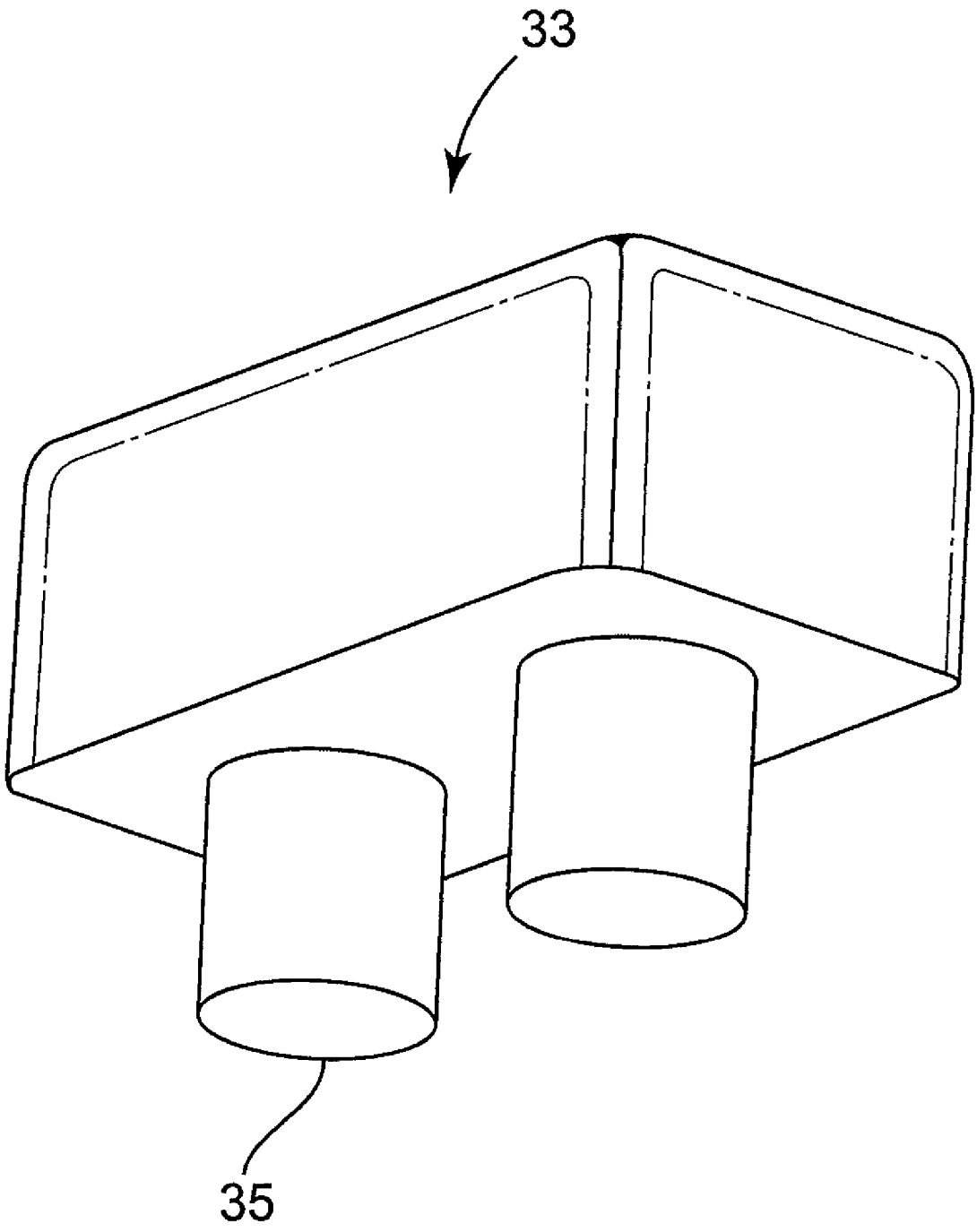
FIG. 16 is a bottom pictorial view of the paver piece of FIG. 15.
Figure 17:
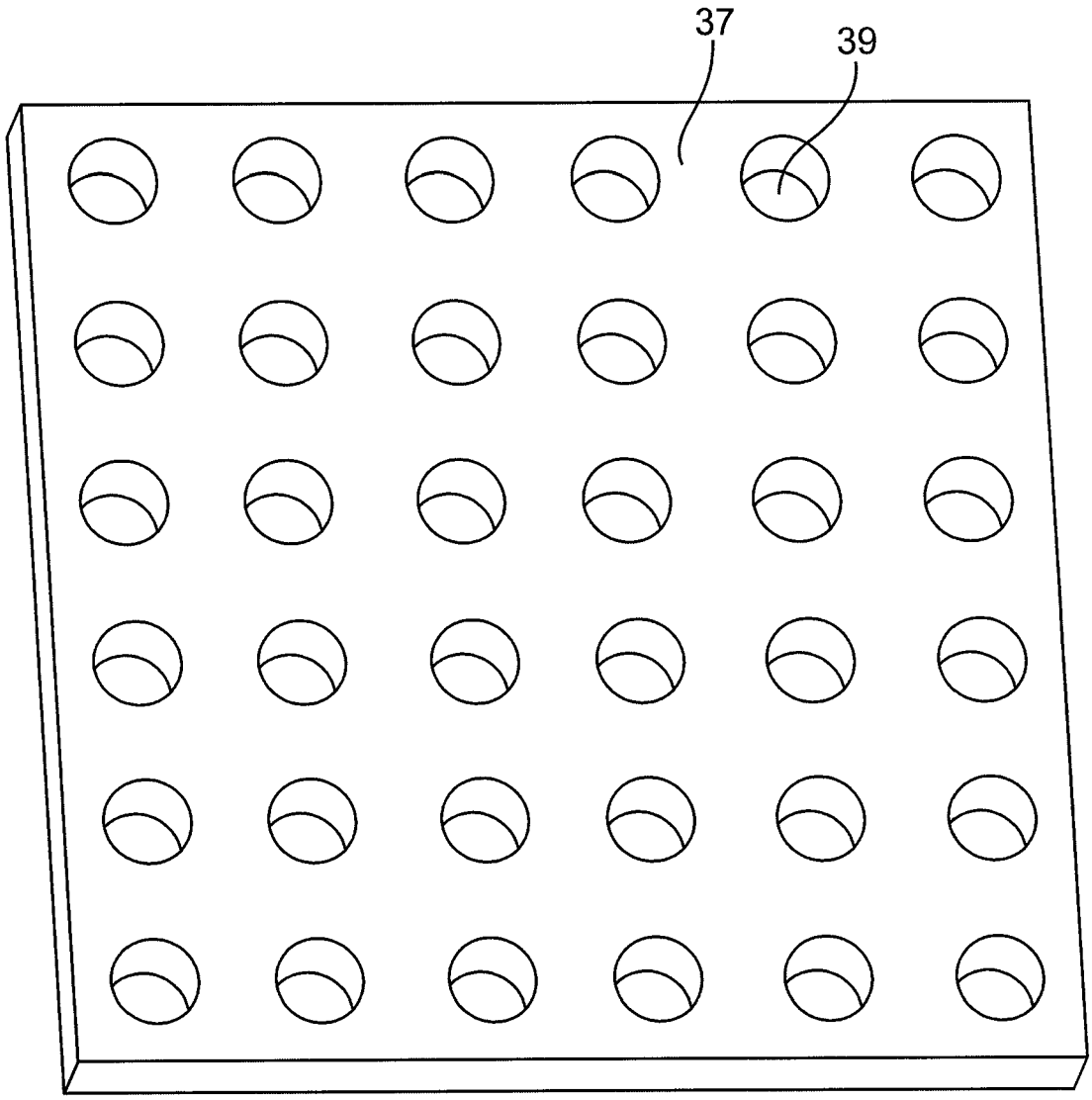
FIG. 17 is a top pictorial view of a substrate complementary with the paver piece of FIGS. 15 and 16.
Figure 18:
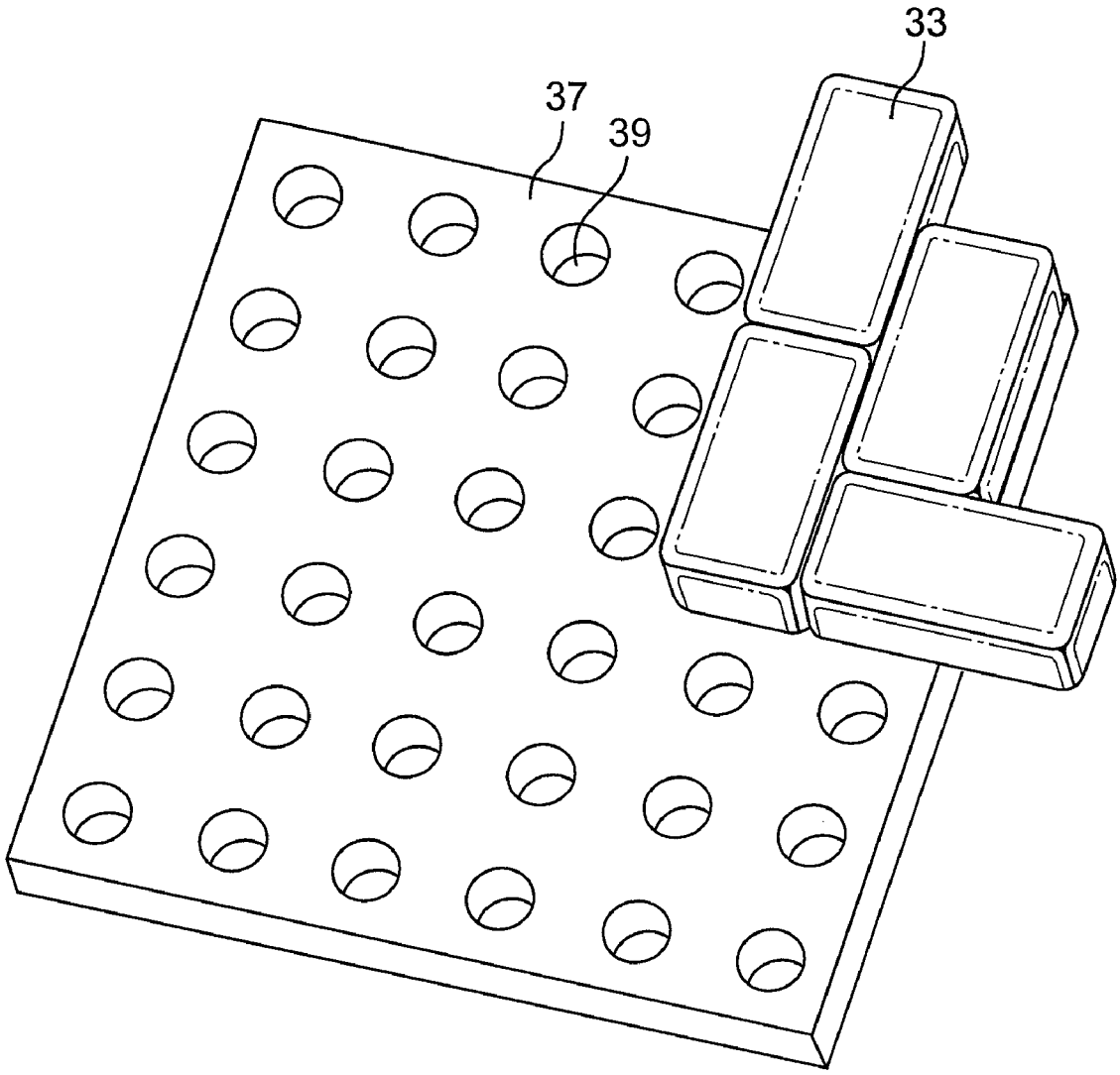
FIG. 18 is a top pictorial view of a substrate of FIG. 17 with paver pieces of FIGS. 16 and 17 coupled thereto.
Figure 19:
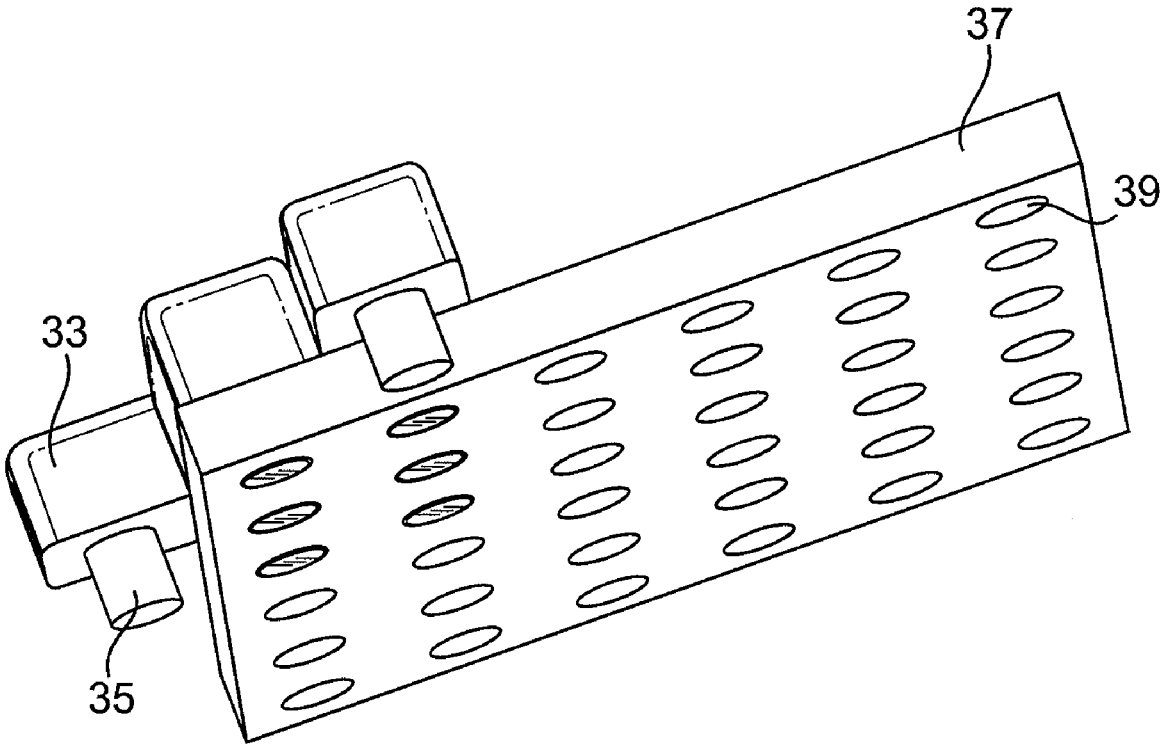
FIG. 19 is a bottom pictorial view of a substrate of FIG. 17 with paver pieces of FIGS. 16 and 17 coupled thereto.

FIGS. 15-19 illustrate another embodiment of coupled paver pieces and substrates. Any suitable shape or geometry of paver pieces and substrates including any variety of protrusions or recesses may be used so long as the paver pieces and substrates are sufficiently complementary to provide lateral stability. FIGS. 15 and 16 illustrate an alternative paver piece. FIG. 17 illustrates a complementary alternative substrate. FIGS. 18 and 19 illustrate paver pieces as shown in FIGS. 15 and 16 coupled with a substrate as shown in FIG. 17. As seen in FIGS. 15 and 16, the paver piece 33 includes protrusions 35 on its bottom surface. In the embodiment shown, the protrusions 35 are generally cylindrical. In alternative embodiments, the protrusions 35 may be any suitable shape for receipt by a recess of the substrate. The substrate 37, shown in FIG. 17, is configured for coupling with one or more paver pieces 33. The substrates 37 includes recesses 39 for receiving the protrusions 35 of the paver piece 33. As seen in FIGS. 18 and 19, a paver piece 33 can extend between one substrate 37 and an adjacent substrate (not shown) for providing lateral stability between substrates.

Figure 20:
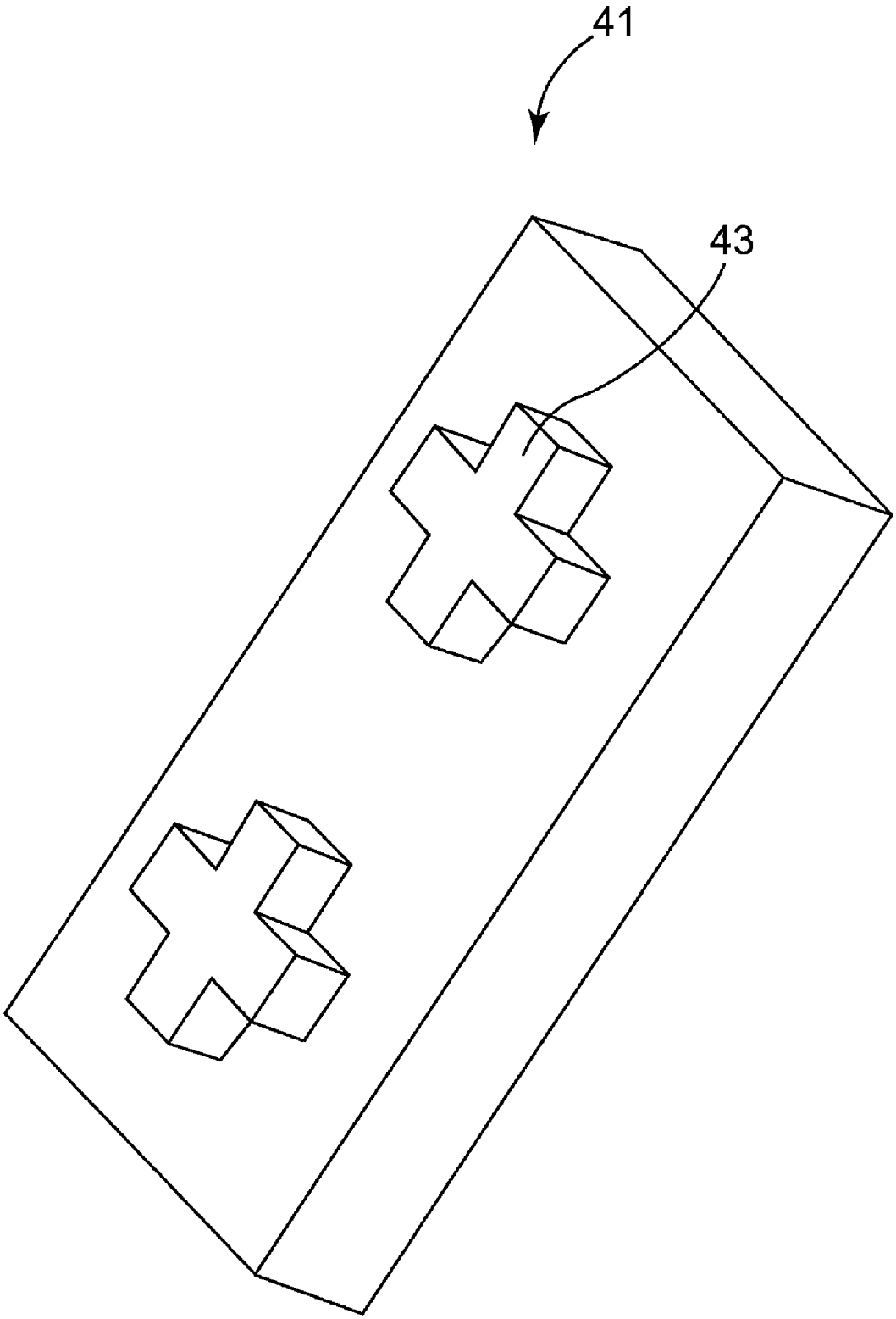
FIG. 20 is a bottom pictorial view of a paver piece in accordance with yet another embodiment.
Figure 21:
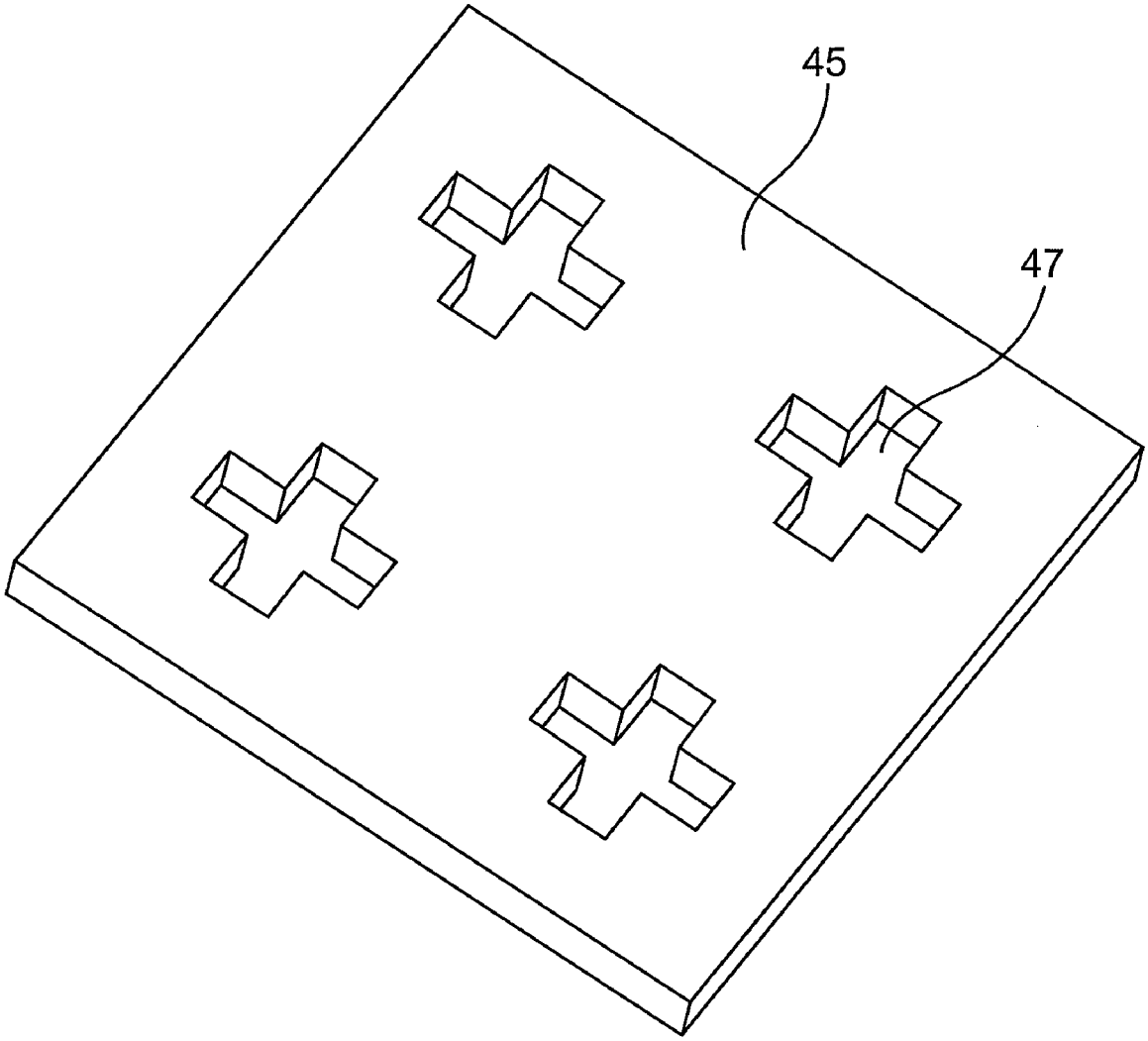
FIG. 21 is a top pictorial view of a substrate complementary with the paver piece of FIG. 20.

FIGS. 20 and 21 illustrate yet a further embodiment of complementary paver pieces and substrates. FIG. 20 illustrates an alternative paver piece. FIG. 21 illustrates a complementary alternative substrate. As seen in FIG. 20, the paver piece 41 includes cross shaped protrusions 43 on its bottom surface. The substrate 45, shown in FIG. 21, is configured for coupling with one or more paver pieces 41 and includes recesses 47 for receiving the protrusions 43 of the paver piece 41. Accordingly, the recesses 47 of the substrate 45 are cross shaped to receive the cross shaped protrusions 43 of the paver piece 41.

The spacing of the complementary features on the substrates may be varied to adjust the overall sizing of the paver system. Thus, using the embodiment of FIGS. 15-17 as an example, the area of ground to be covered by the substrates 37 may be measured, and the nearest whole number of paver pieces 33 to cover that area can be determined using simple equations. The substrates 37 may be designed with a corresponding number of complementary features or recesses 39 spaced evenly over the area of ground to be covered. Thus, when the paver pieces 33 are distributed over the substrates 37, the paver pieces 33 cover the surface area of the ground to be covered without requiring any modification of the substrates or paver pieces. Alternatively, as previously discussed, the polymeric material of the paver pieces and/or substrates may be easily cut using home tools or carpentry equipment. Thus, if a whole number of standard substrates and/or paver pieces does not evenly cover the surface area, the substrates and/or the paver pieces may be cut to fit the surface area.

Again, as would be appreciated by one skilled in the art, while specific embodiments of paver pieces and substrates are shown, any suitable complementary configuration of paver pieces and substrates may be used so long as the paver pieces and substrates are complementary and their interaction provides lateral stability via the substrate.

Preassembled Units with Substrate

With specific reference to the embodiment of FIGS. 1-4 and 8*a*-10*d*, a preassembled paver system unit may be provided by placing a plurality of paver pieces 14 on a substrate 12. Preassembled units may be provided using the paver pieces and/or substrates of any of the embodiments herein disclosed. Once the paver pieces 14 are placed or pre-loaded on the substrates, the paver pieces are prevented from moving laterally and the combined preassembled paver pieces and substrate may be placed as a unit in final position on a graded surface. The preassembled paver system unit is enabled because of the low weight and interlocking nature of the pieces. Such preassembled paver system unit increases speed of installation, particularly with large areas. To facilitate handling of preassembled units of larger size and/or weight, the substrate may be formed with lift apertures for receiving tons of a conventional pallet lifter and/or fork lift. To achieve substrate interlocking, such pre-assembled units can be created with selected areas of the substrate not covered by a paver piece until the unit is placed. At that time one or more paver pieces spanning between adjacent substrates may be placed.

In particular embodiments, preassembled units with substrates may be provided with the paver pieces in a preconfigured decorative pattern. For example, if a paver system having paver pieces in a circular pattern is desired, the circular pattern of paver pieces may be achieved on a substrate in a preassembled unit prior to installation. In some embodiments, where a particularly intricate pattern is desired, the pattern may be input into a computer system and the computer system may calculate and output configuration for the substrate and/or the paver pieces. The output configuration may then be molded or extruded as described below. Because of the lightweight nature of the paver system, a preassembled unit, whether or not in a pattern, is relatively lightweight and easy to transport. Thus, a patterned paver system is much more easily designed and installed using the paver system of the present invention than conventional cementitious or clay systems wherein the design must be laid during installation and the pieces carefully maneuvered and/or modified to fit the design. It should be noted that the paver system may be provided in a decorative pattern in a non preassembled unit embodiment as well.

The paver system 10, comprising a plurality of substrates 12 and a plurality of paver pieces 14 enables easy alignment and distribution of load. More specifically, the paver pieces 14 are easily aligned on the substrates 12. Thus, during laying of the paver system 10, the substrates 12 are placed on the surface to be covered by the paver system 10. The paver pieces 14 are then placed over the substrates 12. After placement of the paver pieces 14, sand may be distributed over the paver system for infiltration between the paver pieces 14 in the areas created by the spacers 24. The sand provides sand-locking.

Figure 22:
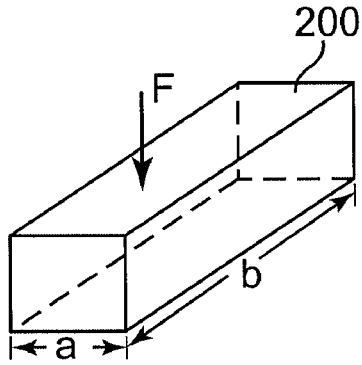
FIG. 22 is diagram showing force distribution of a conventional paver when loaded.
Figure 23:
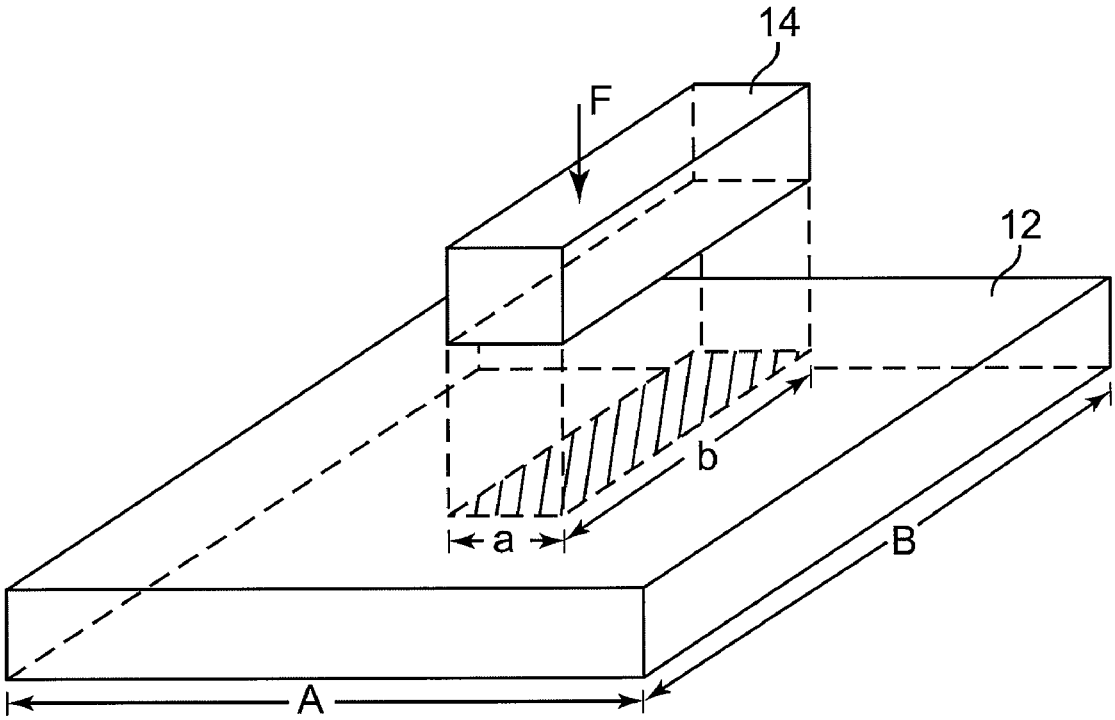
FIG. 23 is diagram showing force distribution of a paver piece and a substrate of a paver system in accordance with one embodiment when loaded.

In a conventional paver system, each paver supports its own weight and weight placed on the paver. Thus, as shown in FIG. 22, a vertical point load having a force of F is distributed over an area equal to the surface area of the paver 200 (a*b). The force distribution on the ground beneath the paver 200 thus is F/(a*b). In contrast, in accordance with the present invention each paver piece 14 is coupled to a substrate 12 and force is distributed over the substrate 12 (assuming a significantly rigid substrate). Thus, as shown in FIG. 23, a vertical point load having a force of F is distributed over a surface area of the substrate (A*B), which is larger than the surface are of the paver piece (a*b). The force distribution on the ground beneath the paver system thus is F/(A*B). Therefore, the paver system of the present invention yields a lower localized pressure and less concentrated compressive load on the underlying surface than a conventional paver system.

While the above description assumes a rigid substrate, it should be obvious to one skilled in the art that, even assuming the substrate to be somewhat less rigid, the force is distributed over an area larger than that of a conventional paver system. For example, the force F of the vertical point load is distributed over an area more than that of the surface area of the paver (a*b) even though that area may be less than the total area of the substrate (A*B).

Self-substrates

As discussed above, the substrate, whether separate from or integral to the paver pieces, provides a positive locking system that prevents pavers from moving laterally, provides a means to transfer and install multiple paver blocks at one time, and provides a means to disperse compression loads applied to the paver pieces over a wide area. FIGS. 24 and 25 illustrate an embodiment wherein the substrate is integral with the paver pieces. Thus, the paver pieces are mating and interlocking with one another and thus comprise self-substrates.

Figure 24A:
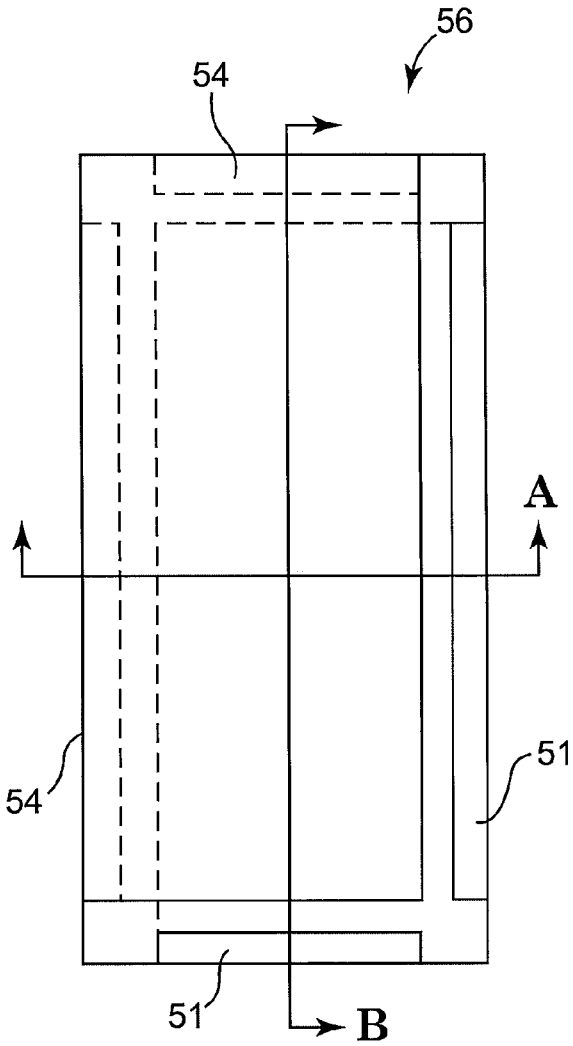
FIG. 24*a* is a top view of a self-substrate paver piece in accordance with one embodiment.
Figure 24B:
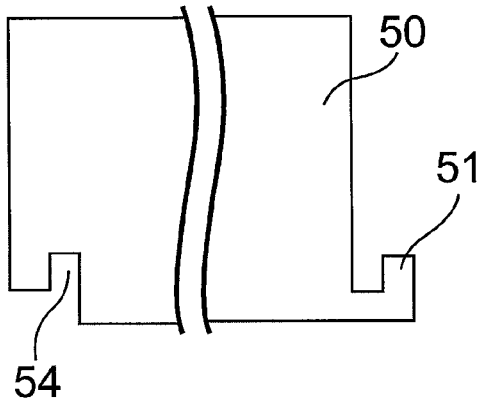
FIG. 24*b* is a side cross-sectional view (broken) of the self-substrate paver piece of FIG. 24*a*.
Figure 25:
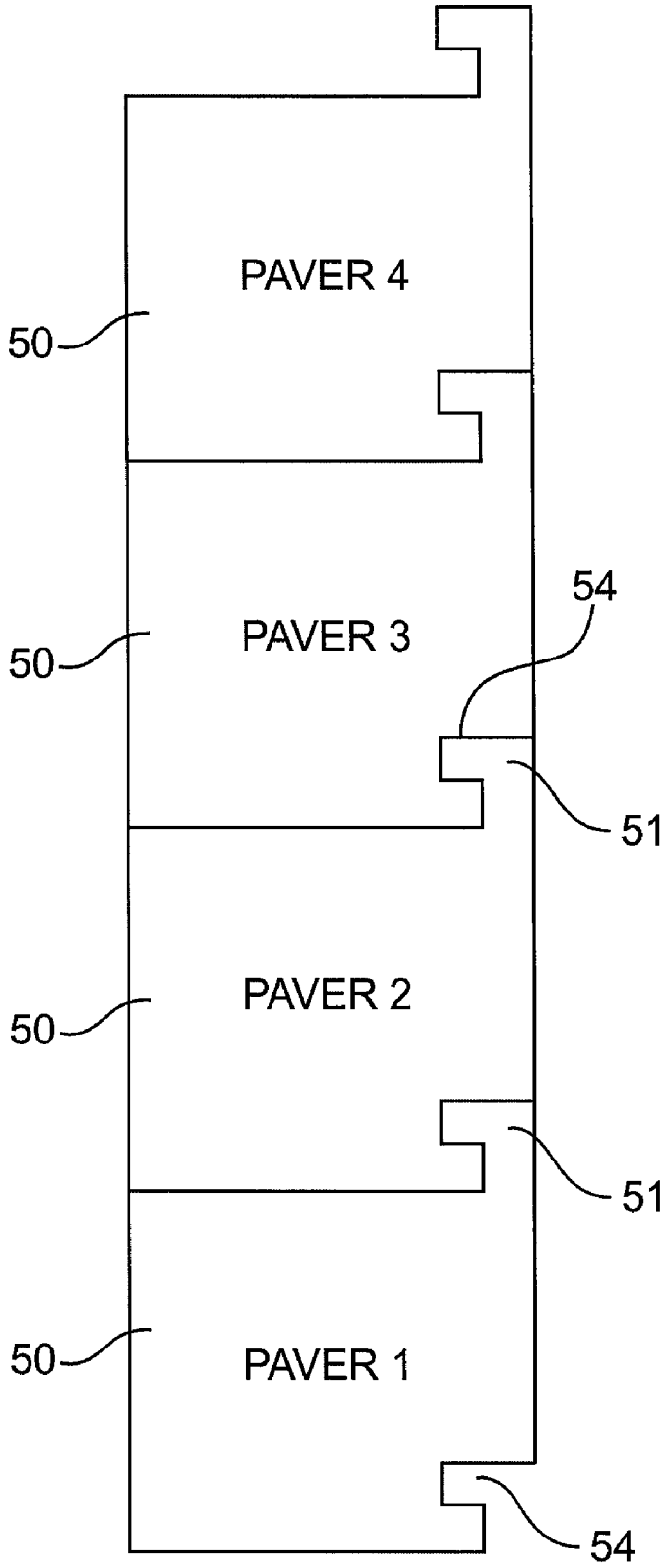
FIG. 25 is a simplified side view of a plurality of interlocked self-substrate paver pieces of FIG. 24.

FIG. 24*a* is a top view of a paver piece 50. FIG. 24*b* is a side-cross-sectional (broken) view of the self-interlocking paver piece 50 along either line A or line B of FIG. 24*a*. FIG. 25 is a side view of several interlocked paver pieces 50. As shown, each paver piece includes an extending lip 51 and groove 54. The lip 51 and groove 54 are correspondingly shaped and sized such that the lip and groove mate. As seen most clearly, a lip 51 is provided on a two perpendicular sides of the paver piece 50 and a groove 54 is provided on the remaining two perpendicular sides of the paver piece 50. Thus, the paver pieces 50 interlock with one another in two directions.

Other Features

Heating and Cooling Features

Figure 26A:
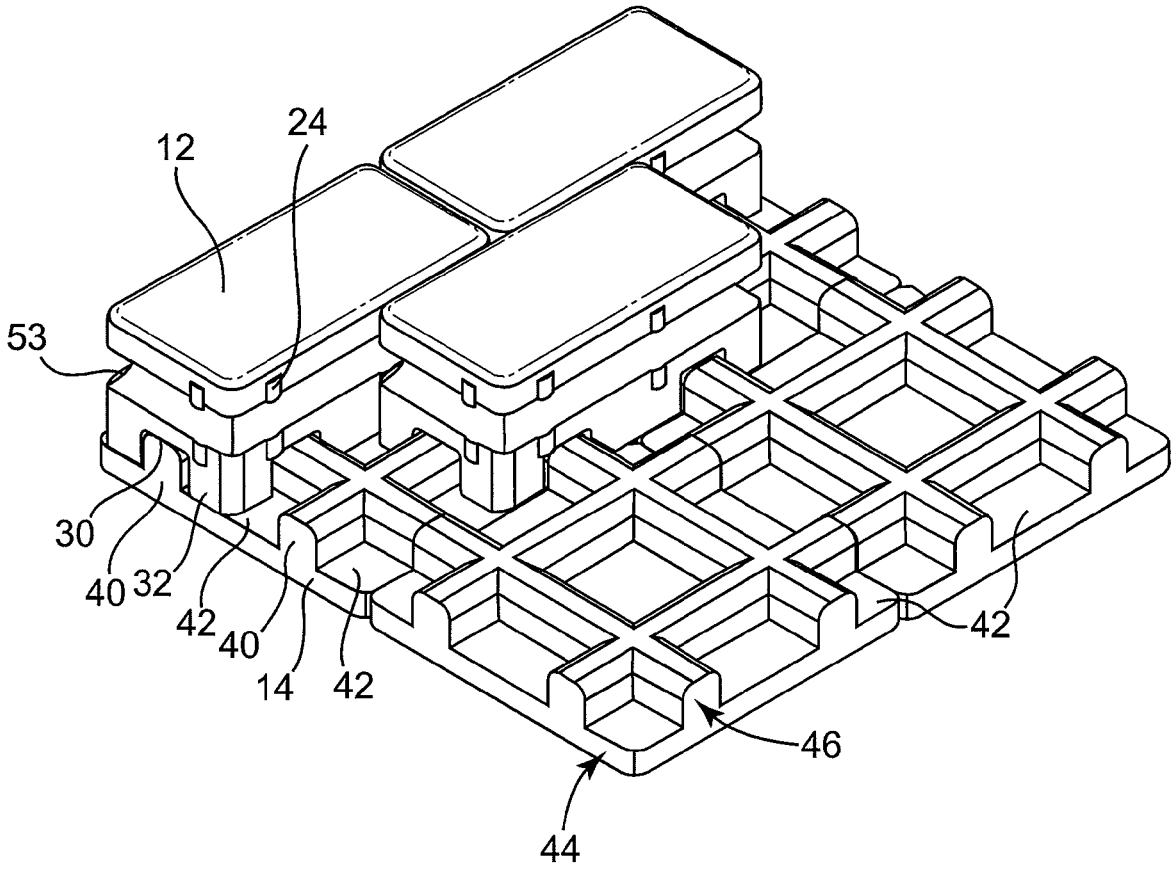
FIG. 26*a* is a top pictorial view of a paver system for receiving a heating element in accordance with one embodiment.
Figure 26B:
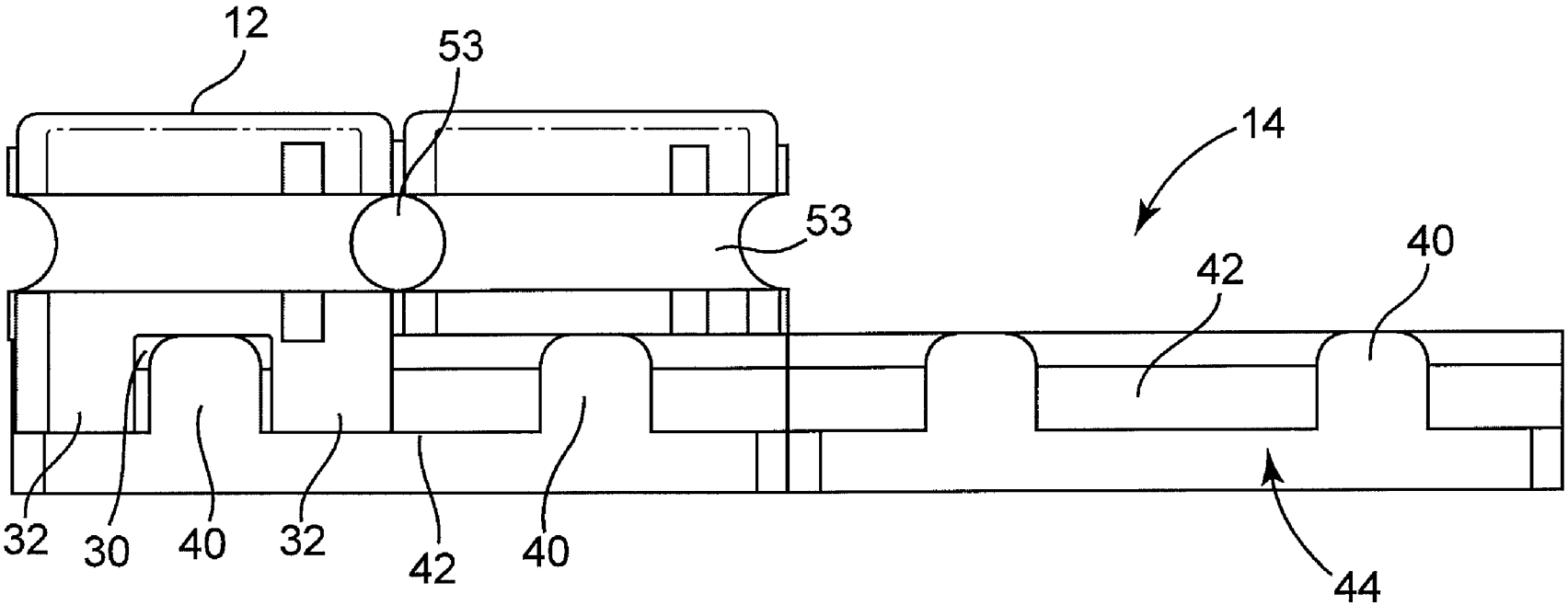
FIG. 26*b* is a side pictorial view of the paver system of FIG. 26*a*.

As mentioned with reference to FIG. 4, the paver system may include heat delivery elements. Thus, the paver system may be installed with a heating system provided therein. In previous paver systems, the heat delivery element typically is buried in sand beneath the pavers. FIGS. 26*a* and 26*b* illustrate an embodiment wherein conduit spaces are provided along the sides of the paver pieces for receiving a heat delivery element. In FIGS. 26*a* and 26*b*, the heating system may comprise a water or antifreeze plumbing system that may be provided with the paver system, for example, via tubes fit in the channel 53 defined between adjacent paver pieces 12. The plumbing tube may be a flexible plastic tube. The heat delivery element, for example, a plumbing tube, may also be provided in a channel 52 between the paver piece 14 and the substrate 12, as shown in FIG. 4. In the embodiment shown, the channels 52 are provided with the recesses 30 on the bottom surface 18 of the paver piece 14. Thus, the recesses 30 for receiving protrusions from the substrate 12 further comprise channels 52 for receiving a heat delivery element.

Figure 27A:
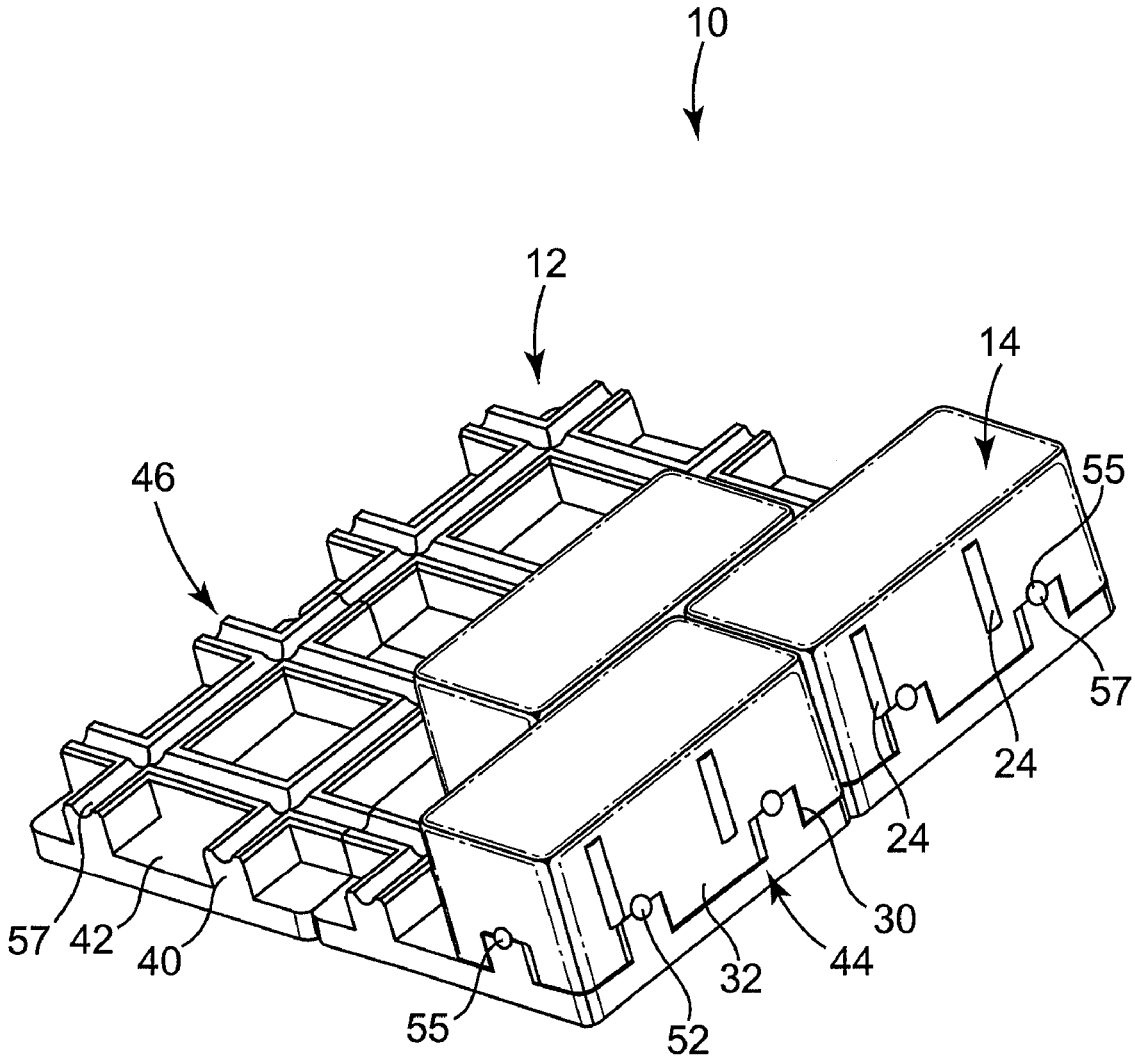
FIG. 27*a* is a top pictorial view of a paver system for receiving a heating element in accordance with one embodiment.
Figure 27B:
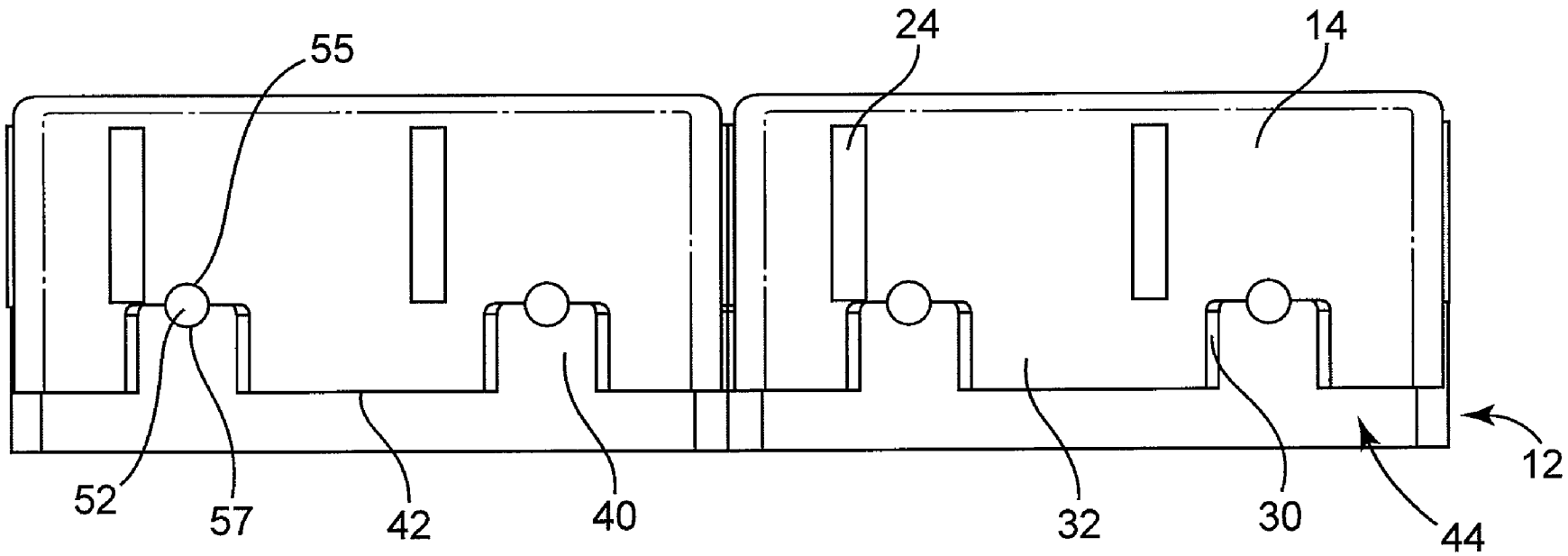
FIG. 27*b* is a side pictorial view of the paver system of FIG. 27*a*.
Figure 28A:
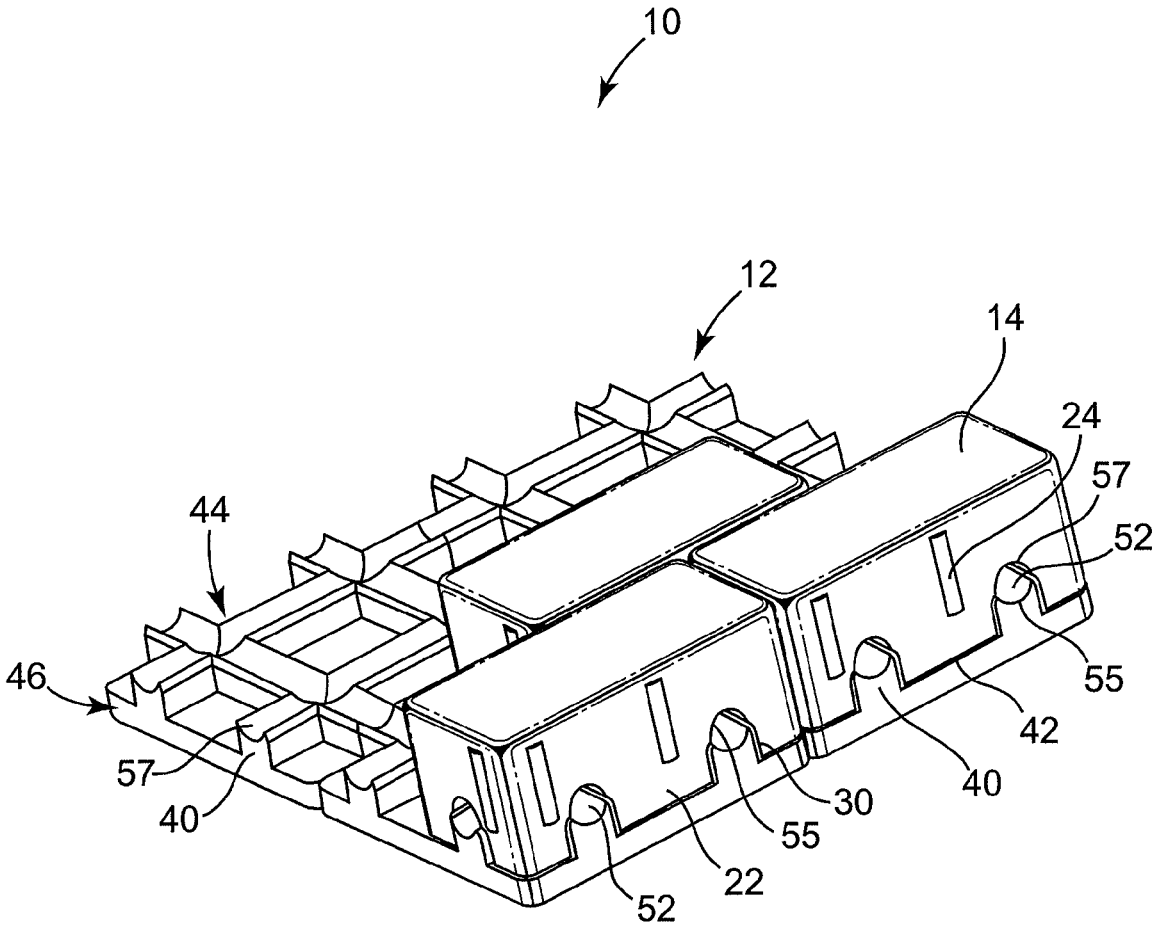
FIG. 28*a* is a top pictorial view of a paver system for receiving a heating element in accordance with one embodiment.
Figure 28B:
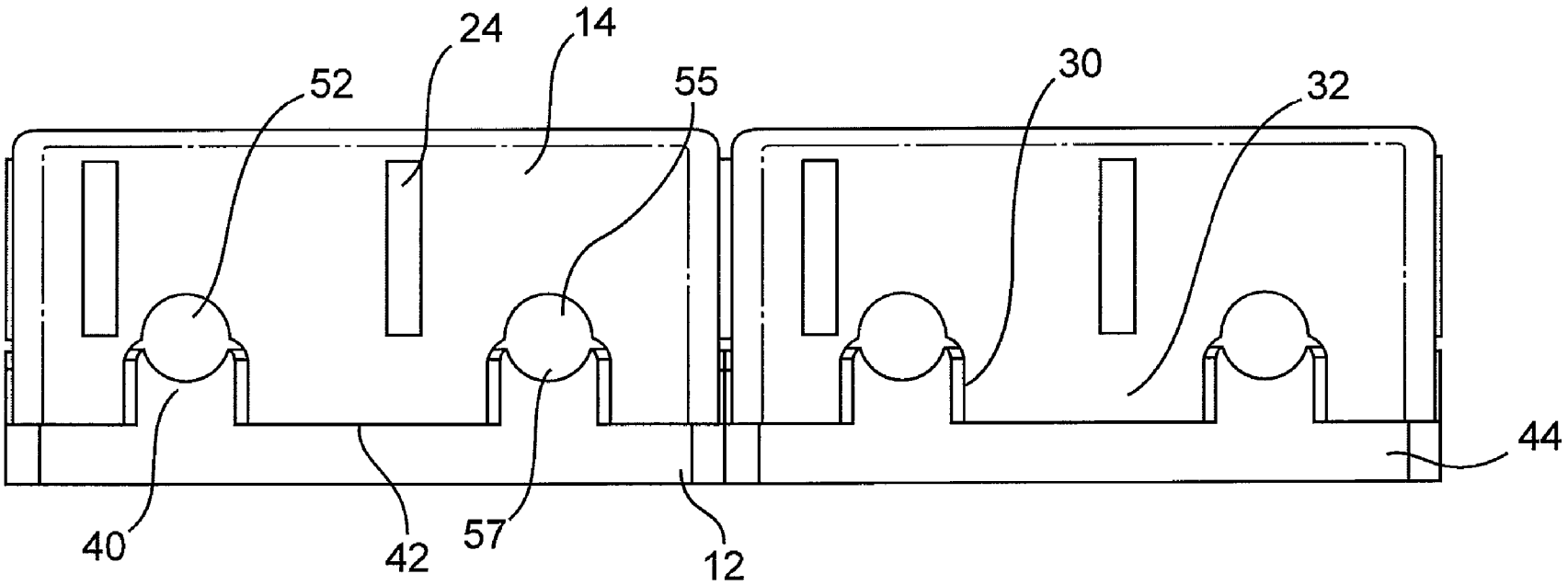
FIG. 28*b* is a side pictorial view of the paver system of FIG. 28*a*.

In alternative embodiments, the heat delivery element may be an electrical resistance element such as a heating cable. Generally, a heating system using plumbing utilizes larger channels 52 while a heating system using electrical resistance elements utilizes smaller channels 52. Thus, as shown in FIGS. 27*a* and 27*b*, relatively small channels 52 are provided between the substrate and the paver pieces for receiving an electrical resistance element such as an electrical cord. In the embodiments shown, the channels 52 are formed by a conduit recess 55 in the coupling recess 30 of the paver piece 14 and a conduit recess 57 in the coupling protrusion 40 of the substrate 12. In contrast, as shown in FIGS. 28*a* and 28*b*, relatively large channels 52 are provided between the substrate and the paver pieces for receiving a plumbing tube.

By providing the heat delivery element directly within the paver system 10, the heated system is more efficient, using less energy than conventional cementitious or clay paving systems. Further, by providing the heat delivery element proximate the surface of the paver system, the heat delivery element may be used to melt ice or snow on the surface of the paver system.

In alternative embodiments, the heat delivery element may be provided within a paver piece 14, between the paver pieces 14, within a substrate 12, between the substrates 12, or in other suitable position within the paver system 10. Forming of the conduits for receiving heat delivery elements that have sufficient strength to resist collapse when the paver pieces are loaded is facilitated by the composite polymeric material The plumbing system may be filled with any of a variety of coolant options (e.g., water, glycol, etc.). The system provides a means to heat and/or cool the paver-substrate system, thus providing climate control of enclosed areas and surface temperature control of exterior areas. Common uses for this type of heating application include walkways and driveways in northern regions in which an end-user would like to thaw snow or ice accumulation without the use of non-environmentally friendly chemicals (e.g., chlorine, salt) or labor intensive manual removal methods (i.e., shoveling, plowing, etc.). Providing the heat delivery element proximate the surface of the paver system facilitates using the heating element to melt ice or snow on the surface of the paver system.

During installation of the paver system, as the paver system is laid, the heat delivery element may be threaded through the conduits and channels. Alternatively, the heat delivery elements may be placed through the conduits or channels in any suitable manner.

Electrical Features

In alternative embodiments, a lighting system may be provided within the channels of FIGS. 26*a*, 26*b*, 27*a*, 27*b*, 28*a*, or 28*b*. Thus, the paver system may be installed with a lighting system provided therein. As described previously, conduits may be provided within the paver pieces. A lighting element such as a rope light may be distributed through the conduits. In one embodiment, rope lights are provided in a channel 52 between the paver piece 14 and the substrate 12, as shown in FIG. 4, and one or more paver pieces have openings (such as for drainage, as discussed above) or translucent portions to permit the light to be viewed. The channels 52 may provided with the recesses 30 on the bottom surface 18 of the paver piece 14. Thus, the recesses 30 for receiving protrusions from the substrate 12 further comprise channels 52 for receiving the lighting element. Electricity may be provided to the lighting system in any suitable manner. In some embodiments, the paver pieces may comprise a translucent polymeric material and/or may comprise a fluorescent or glow-in-the-dark polymeric material. In a fluorescent embodiment, the paver piece acts as a light sink for the sun, providing light during the hours of darkness.

Drainage Features

Figure 29:
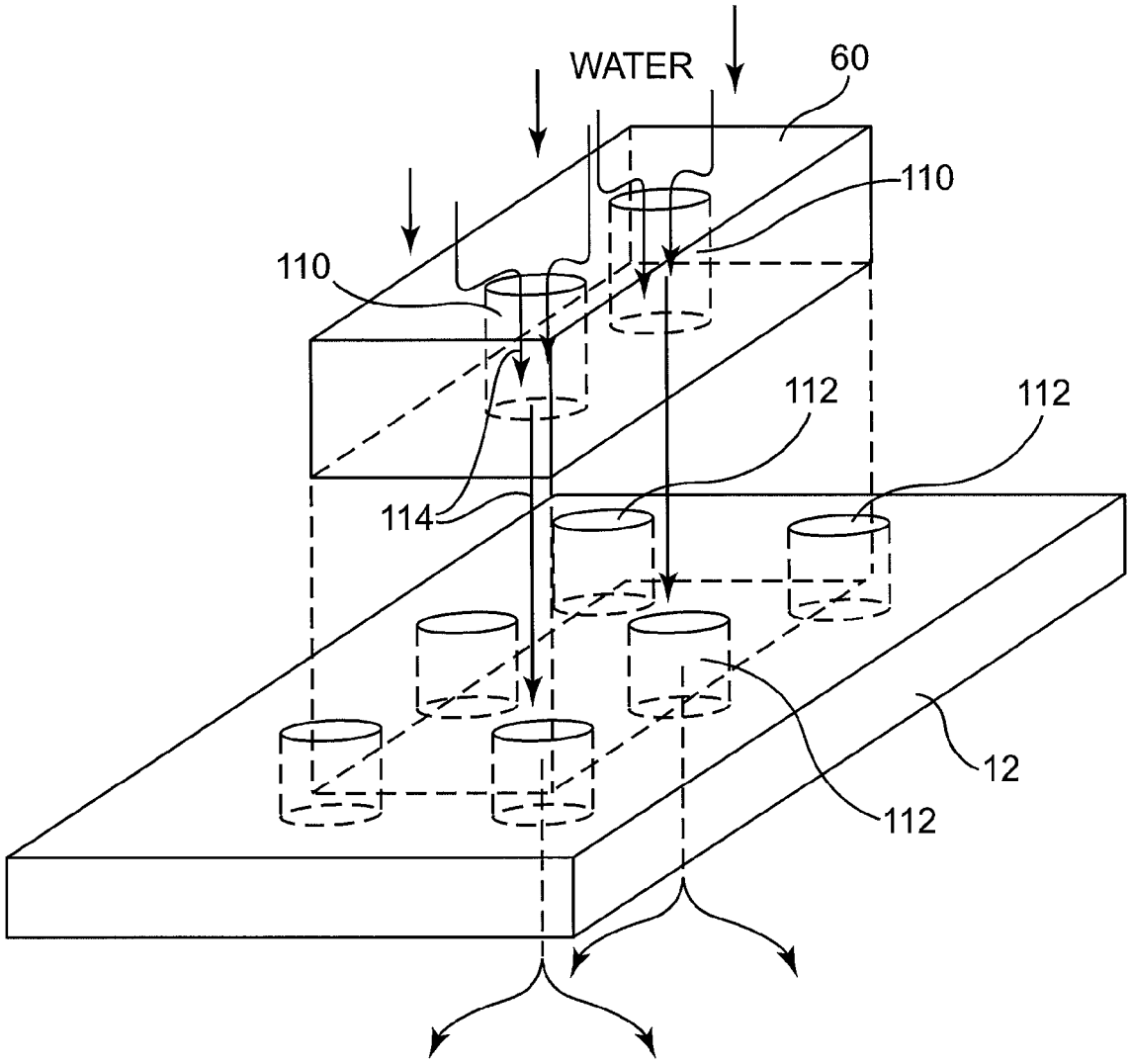
FIG. 29 is an exploded perspective view of a permeable paver system in accordance with one embodiment.

The paver system may be configured with drainage features. A paver system with drainage features is shown in FIG. 29. For simplicity, complementary interlocking features of the paver piece 60 and the substrate 12 are not shown. A paving system 10 using drainage paver pieces 60 with drain apertures 110 and a substrate 12 with drain apertures 112 provides surface-to-ground drainage paths 114 and is a permeable system and meets run-off requirements. Preferably the drainage paths 114 through the paver pieces 14 and substrate 12 form a tortuous path that affords adequate flow but at a low velocity. The system provides a means for water penetration, thus reducing and/or eliminating the need for costly and many times non-environmentally friendly run-off paths and drainage systems that are traditionally used with non-porous concrete and asphalt systems. In the embodiment of FIG. 5-7, the paver piece 14*a*, 14*b* includes one or more drainage holes 15, 17, 19 according to expected drainage flow requirements. The holes 15, 17, 19 may vary in size and shape. In one embodiment, the holes are circular and vary in diameter from approximately 2 mm to approximately 3 cm. In certain embodiments, porous fill, such as gravel (not shown), may be provided within the holes. As discussed with reference to FIGS. 8*a*, 8*b*, 9*a*, and 9*b*, the substrates 12 may comprise apertures 48. The paver pieces and substrate holes provide drainage routes for water draining through the drainage paver pieces 60 of the paver system. Drainage can further be provided using larger gaps provided by the spacers 24 of the paver pieces 14 and/or open grid substrates 12 between paver pieces (see FIGS. 9*a* and 9*b*).

Materials

Polymeric paver pieces as provided herein are easily and precisely formable, lightweight, and durable. They provide compressive strength comparable to cementitious paver pieces and superior tensile strength. Further, the polymeric paver pieces may be easily cut or configured using standard home tooling or home carpentry equipment such as wood saws, table saws, etc. The surface of polymeric pieces formed via injection molding may be slightly rough and, thus, resistant to slippage.

In one embodiment, the paver system comprises paver pieces and substrates comprised of a polymeric material. The polymeric material may comprise rubber and plastic. The rubber may be vulcanized rubber from recycled tires. Recycled car tires are available in a crumb form having varying sizes. Suitable sizes for use with the present invention include ¼" to ⅜" or 20 to 80 mesh. The plastic may be a recycled plastic. In various embodiments, the plastic comprises recycled high density polyethylene (HDPE) or recycled polypropylene. Generally, the plastic acts as a binder and forms a matrix for the rubber. In one embodiment, the polymeric material comprises approximately 75% vulcanized rubber, 24% plastic, and 1-2% additive (described below). In other embodiments, the polymeric material is a composite containing from 50% to 99% by weight recycled rubber and from 1% to 50% plastic.

The paver pieces and/or substrates may be formed via injection molding, as is known in the art. In alternative embodiments, other ways of forming the paver pieces and/or substrates may be used. With specific reference to injection molding, stated briefly, a mold is provided having an internal shape corresponding with the desired shape of the paver piece or the substrate. Generally the mold comprises first and second halves. The mold is clamped to an injection molding machine under pressure for the injection and cooling process. Pelletized resins of rubber and plastic (e.g. HDPE) are fed into the injection molding machine and heated to a melting point. Additives may be fed into the machine at or around the time the pelletized resins are fed into the machine. The melted resin (with additives if used) is injected into the mold. Injection may be via, for example, a screw or ramming device. A dwelling phase follows injection. During the dwelling phase, the molten resins are contained within the mold and pressure is applied to all of the cavities within the mold. Pressure may be applied via, for example, hydraulic or mechanical means. After the molten material cools, the mold is opened by separating the two halves of the mold and the molded material is removed. Removal may be done by ejecting the molded material from the mold with ejecting pins.

Using, for example, injection molding, holes may be formed in the substrate or paver pieces to provide for various features as described above.

As stated previously, additives may be added to the process with the palletized resin. Additives may include colorants with UV stabilizers, fluorescent additives, flame retardants, agents to improve coupling strength between the recycled rubber and the plastic, talc, glass, metal, minerals, etc. Thus, for example, the rubber and plastic (or, in some embodiments, only rubber or only plastic) material may be mixed with colorants to provide a wide array of end product colors that resemble brick, stone, concrete, asphalt, or other decorative hues. In another embodiment, the rubber and plastic material may be mixed with UV stabilizers that prevent the decay and visual degradation of the product from its original manufactured state. In another embodiment, the rubber and plastic material is mixed and/or replaced with one or more fluorescent materials and/or phosphorescent pigments to create pavers that act as a light-sink. Here the polymeric composite may contain 1% to 10% by weight fluorescent or phosphorescent materials, and may contain only plastic or a plastic rubber blend. The system provides a solar powered, lit (i.e., glow-in-the dark) walkway system that costs substantially less to install, maintain, and operate than traditional electrically powered lighting systems. While specific reference is made to a rubber and plastic composite polymeric material, such reference is for the purposes of description only. As may be appreciated by one skilled in the art, other lightweight, precisely formable polymeric materials may be used.

Thus, additives to the polymeric material may include, for example, colorants such as Everlast colorants or Everwood colorants available from Hudson Color Concentrates (http://www.hudsoncolor.com/news.htm) or Super Pellets available from E-Z Color Corporation (http://www.e-zcolor.com/products/superPellets.php), and UV stabilizer, glow-in-the-dark agents such as a phosphorescent plastic available from RTP Company (http://www.rtpcompany.com/info/flyers/glow.pdf). Generally, additives are added to the injection molding process for the paver pieces. However, coloration and protection against sunlight are less of a concern for the substrates and may not be used during injection molding of the substrates.

In alternative embodiments, the paver pieces and/or substrate may be formed via compression molding, extrusion, or other suitable technique for polymer matrix material.

Although the present invention has been described in reference to preferred embodiments, persons skilled in the art will recognize that changes may be made in form and detail without departing from the spirit and scope of the invention. For example, in alternative embodiments, the polymeric paver pieces may be used for retaining wall blocks, decorative exterior 'faux brick' walls, foundation blocks, etc.

What is claimed is:

1. A paver system of preassembled units comprising:

a plurality of paver pieces, each of the paver pieces comprising a top surface and a bottom surface;

at least one substrate supporting the plurality of paver pieces with their top surfaces in a closely spaced relationship substantially in a common plane, the paver pieces covering substantially the entire substrate and wherein the substrate further includes lift apertures for receiving the tongs of a pallet lifter;

wherein the paver pieces include a coupling feature formed at the bottom surface and the substrate includes an upper surface formed with a complementary coupling feature, the paver pieces mating with the substrate via the coupling feature and the complementary coupling feature to form a paver system with column support providing substantially uniform compressive strength across the paver piece top surfaces, whereby the paver pieces preassembled on the substrate in mating relationship are prevented from moving laterally and the combined preassembled paver pieces and substrate may be placed as a unit in final position on a base surface.

2. The paver system of claim 1, further comprising paver pieces that span between the at least one substrate and an adjacent substrate and couple to each of the at least one substrate and the adjacent substrate to provide lateral stability for adjacent substrates.

3. The paver system of claim 1 wherein the coupling feature of the paver pieces comprises recesses and the complementary coupling feature of the substrate comprises protrusions, the recesses being adapted to receive the protrusions.

4. The paver system of claim 1 wherein the coupling feature of the paver pieces comprises protrusions and the complementary coupling feature of the substrate comprises recesses, the recesses being adapted to receive the protrusions.

5. The paver system of claim 1, wherein the substrate is sufficiently flexible to contour to a graded surface.

6. The paver system of claim 1, wherein the substrate is substantially rigid.

7. The paver system of claim 1, wherein the paver pieces comprise a composite containing from 50% to 99% by weight of rubber and from 1% to 50% by weight of plastic.

8. The paver system of claim 7, wherein the rubber is recycled tire material.

9. The paver system of claim 7, wherein the plastic is high density polyethylene.

10. The paver system of claim 7, wherein the plastic is polypropylene.

11. The paver system of claim 7, wherein the composite further comprises one or more additives.

12. The paver system of claim 11, wherein the additive is a colorant.

13. The paver system of claim 1, wherein the paver pieces comprise a composite containing from 1% to 99% by weight of plastic and 1% to 10% by weight of fluorescent material, whereby the paver pieces have light-sink capabilities.

14. The paver system of claim 1, wherein at least one of the paver pieces or the substrate is configured to receive a delivery element.

15. The paver system of claim 14, wherein the delivery element is selected from the group consisting of a heat fluid delivery element, an electrical resistance heating element, an electrical element, and a light delivery element.

16. The paver system of claim 14, wherein conduits for receiving the delivery element are formed between adjacent paver pieces.

17. The paver system of claim 14, wherein conduits for receiving the delivery element are formed between paver pieces and the substrate.

18. The paver system of claim 1, wherein one of the paver pieces or the substrate comprises drainage paths.

19. The paver system of claim 1, further comprising conduits for receiving heating or cooling delivery elements in heat transfer contact with the paver system, said column support providing energy transfer paths between the delivery elements and the paver piece top surfaces.

* * * * *